US005747209A

United States Patent [19]

Takiguchi et al.

[11] Patent Number: 5,747,209

[45] Date of Patent: May 5, 1998

[54] TONER FOR DEVELOPING ELECTROSTATIC IMAGES CONTAINING AROMATIC HYDROXYCARBOXYLIC ACID AND METAL COMPOUND OF THE AROMATIC HYDROXYCARBOXYLIC ACID

[75] Inventors: Tsuyoshi Takiguchi, Kawasaki; Kenji Okado, Yokohama; Masaaki Taya, Kawasaki; Ryoichi Fujita, Kawasaki; Makoto Kanbayashi, Kawasaki; Kohji Inaba, Yokohama; Wakashi Iida, Higashikurume; Kazunori Kato, Mitaka; Tetsuya Ida, Kawasaki; Shinya Yachi, Yokohama, all of Japan

[73] Assignee: Canon Kabushiki Kaisha, Tokyo, Japan

[21] Appl. No.: 640,077

[22] Filed: Apr. 30, 1996

[30] Foreign Application Priority Data

May 2, 1995 [JP] Japan ..... 7-131189
Apr. 23, 1996 [JP] Japan ..... 8-123921

[51] Int. Cl.[6] ..... G03G 9/00

[52] U.S. Cl. ..... 430/106.6; 430/109; 430/110

[58] Field of Search ..... 430/106.6, 109, 430/110

[56] References Cited

U.S. PATENT DOCUMENTS

| | | | |
|---|---|---|---|
| 2,297,691 | 10/1942 | Carlson | 95/5 |
| 3,666,363 | 5/1972 | Tanaka et al. | 355/17 |
| 4,071,361 | 1/1978 | Marushima | 96/1.4 |
| 4,206,064 | 6/1980 | Kiuchi et al. | 430/106 |
| 4,590,140 | 5/1986 | Mitsuhashi et al. | 430/102 |
| 4,762,763 | 8/1988 | Nomura et al. | 430/110 |
| 4,845,003 | 7/1989 | Kiriu et al. | 430/110 |
| 5,180,649 | 1/1993 | Kukimoto et al. | 430/106.6 |
| 5,200,288 | 4/1993 | Ando et al. | 430/110 |
| 5,268,248 | 12/1993 | Tanikawa et al. | 430/106 |
| 5,338,894 | 8/1994 | Uchiyama et al. | 118/653 |
| 5,346,795 | 9/1994 | Pickering et al. | 430/110 |
| 5,348,829 | 9/1994 | Uchiyama et al. | 430/106.6 |
| 5,397,667 | 3/1995 | Law et al. | 430/106 |
| 5,403,690 | 4/1995 | Kuramoto et al. | 430/110 |
| 5,547,800 | 8/1996 | Nishimori et al. | 430/110 |
| 5,578,407 | 11/1996 | Kasuya | 430/106 |

FOREIGN PATENT DOCUMENTS

| | | | |
|---|---|---|---|
| 0490370 | 6/1992 | European Pat. Off. | G03G 9/097 |
| 36-10231 | 7/1961 | Japan . | |
| 42-23910 | 11/1967 | Japan . | |
| 43-24748 | 10/1968 | Japan . | |
| 55-42752 | 11/1980 | Japan | G03G 9/08 |
| 56-13945 | 4/1981 | Japan | G03G 9/08 |
| 59-53856 | 4/1984 | Japan | G03G 9/08 |
| 59-61842 | 4/1984 | Japan | G03G 9/08 |
| 63-2074 | 1/1988 | Japan | G03G 9/08 |
| 63-33755 | 2/1988 | Japan | G03G 9/10 |
| 63-208865 | 8/1988 | Japan | G03G 9/08 |
| 63-237065 | 10/1988 | Japan | G03G 9/08 |
| 64-10261 | 1/1989 | Japan | G03G 9/08 |
| 4-83262 | 3/1992 | Japan | G03G 9/087 |
| 4-347863 | 12/1992 | Japan | G03G 9/08 |

OTHER PUBLICATIONS

Patent Abstracts of Japan, vol. 4, No. 468 (P-1115) Dec. 1990, based on JP2-187769.

*Primary Examiner*—Mark Chapman
*Attorney, Agent, or Firm*—Fitzpatrick, Cella, Harber & Scinto

[57] ABSTRACT

A toner for developing electrostatic images is formed of toner particles comprising (a) a binder resin, (b) a colorant or magnetic material, (c) an aromatic hydroxycarboxylic acid (A), and (d) a metal compound of the aromatic hydroxycarboxylic acid (A). The aromatic hydroxycarboxylic acid (A) and the metal compound of the aromatic hydroxycarboxylic acid (A) are contained in a weight ratio of 1:99 to 10:90. As a result of co-inclusion of a small amount of the aromatic hydroxycarboxylic acid (A) in addition to the metal compound thereof, the resultant toner is provided with a quick chargeability in a low humidity environment and an improved level of triboelectric charge in a high humidity environment, presumably because of the stabilization effect of the small amount of the aromatic hydroxycarboxylic acid (A) on the metal compound thereof.

21 Claims, 1 Drawing Sheet

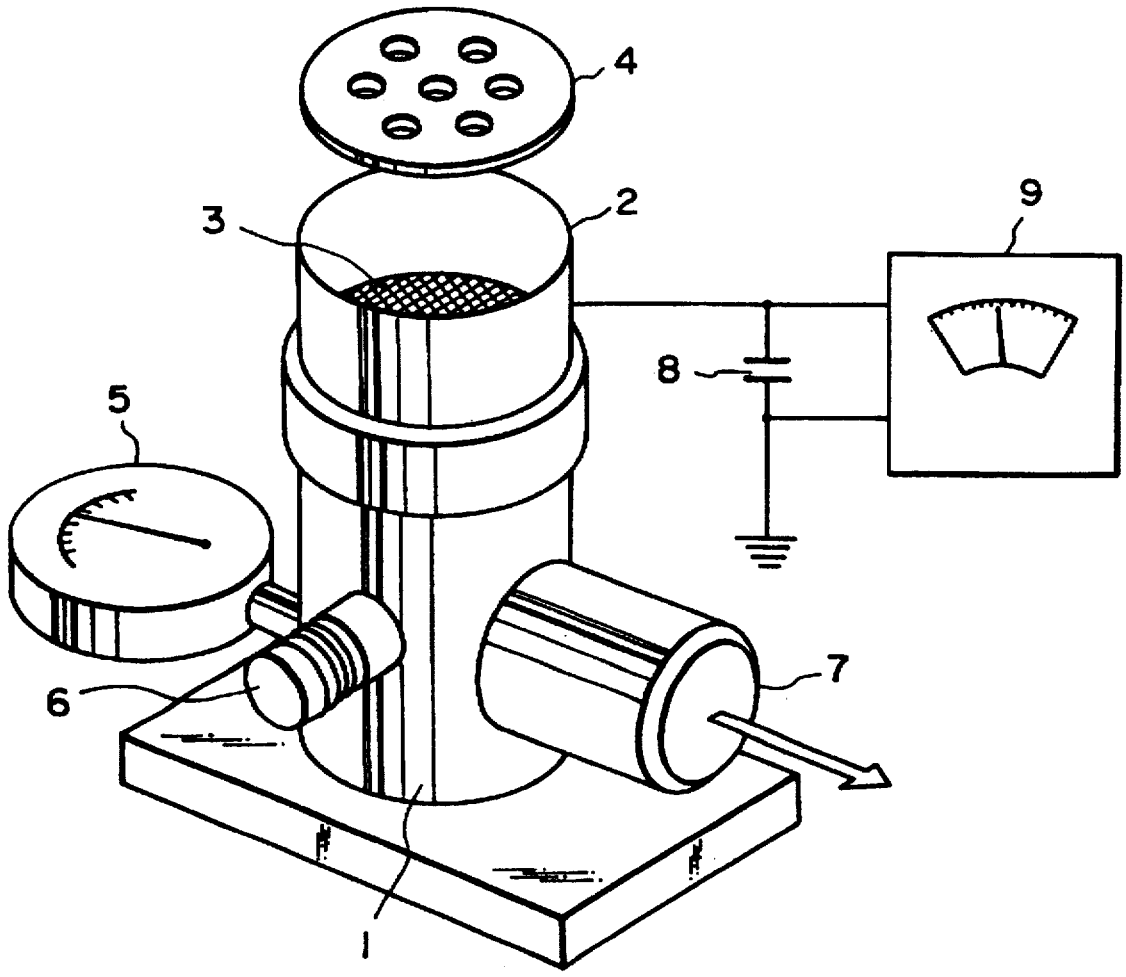
4
2
3
9
8
5
7
6
1

TONER FOR DEVELOPING ELECTROSTATIC IMAGES CONTAINING AROMATIC HYDROXYCARBOXYLIC ACID AND METAL COMPOUND OF THE AROMATIC HYDROXYCARBOXYLIC ACID

FIELD OF THE INVENTION AND RELATED ART

The present invention relates to a toner for developing electrostatic images in image forming methods, such as electrophotography and electrostatic recording.

Hitherto, various methods based on electrophotography have been proposed, e.g., in U.S. Pat. Nos. 2,297,691; 3,666,363 (corr. to Japanese Patent Publication (JP-B) 42-23910); and U.S. Pat. No. 4,071,361 (corr. to JP-B 43-24748).

Developing methods for developing electrostatic images include dry-process developing methods and wet-process developing methods.

In the dry developing methods, there has been used a toner comprising fine toner particles formed by dispersing a dye or a pigment in a resin. The toner particles may comprise fine particles on the order of 1–30 μm comprising a colorant or a magnetic material dispersed in a binder resin, such as a styrene copolymer. Such toner particles have been produced, e.g., through a process wherein a binder, a colorant or a magnetic material, etc., are melt-kneaded, followed by cooling, pulverization and classification into toner particles, or a process wherein a polymerizable monomer mixture including a polymerizable monomer, a colorant or a magnetic material, a polymerization initiator, etc., is dispersed and formed into particles in an aqueous medium, followed by polymerization to produce toner particles. On the other hand, toners include a non-magnetic toner and a magnetic toner, each of which may be used either as a monocomponent type developer or to constitute a two-component type developer.

A toner is caused to have a positive or negative charge depending the polarity of an electrostatic image to be developed therewith.

A toner can be charged by utilizing a triboelectric chargeability of a resin as a toner component, but the toner chargeability in this case is generally low. In order to provide a desired triboelectric chargeability to a toner, it has been frequently practiced to add to the toner a dye and/or a pigment, and further a charge control agent, for imparting a chargeability.

The charge control agents include a positive charge control agent, examples of which may include: nigrosine dyes, azine dyes, copper phthalocyanine pigments, quaternary ammonium salts, and polymers having a quaternary ammonium salt as a side chain group; and also a negative charge control agent, examples of which may include: metal complex salts of monoazo dyes; metal complexes or metal salts of salicylic acid, naphthoic acid, dicarboxylic acids and derivatives of these; and resins having an acidic group.

Among the above, charge control agents, which are colorless, white or pale-colored, are useful for constituting color toners.

Proposals have been made regarding the use of toner containing an aromatic carboxylic acid derivative or a metal compound of aromatic carboxylic acid derivative. For example, U.S. Pat. No. 4,206,064 (corr. to JP-B 55-42752) has proposed salicylic acid metal compounds and alkylsalicylic acid metal compounds. Japanese Laid-Open Patent Application (JP-A) 63-2074, JP-A 63-33755 and JP-A 4-83262 have proposed salicylic acid-based zinc compounds. JP-A 63-208865, JP-A 63-237065 and JP-A 64-10261 have proposed salicylic acid-based aluminum compounds. However, no specific disclosure has been made regarding the content of such salicylic acid-based compounds per se, in addition to the metal compounds thereof, and the content of a salicylic acid-based compounds has been believed to be below a detection lower limit.

JP-A 4-347863 has proposed a toner containing a mixture of a polycyclic aromatic hydroxycarboxylic acid and an aromatic hydroxycarboxylic acid metal compound. According to our study, it has been noted that such a toner containing an aromatic hydroxycarboxylic acid metal compound as a metal compound of an aromatic hydroxycarboxylic acid and a polycyclic aromatic hydroxycarboxylic acid which is different in species from the aromatic hydroxycarboxylic acid, shows only a low effect of improving toner charging speed in a low-humidity environment and a low toner triboelectric chargeability-improving effect in a high-humidity environment.

U.S. Pat. No. 5,346,795 has proposed a toner containing a salicylic acid-based compound and a salicylic acid-based aluminum compound in a weight ratio of 1/4–4/1 (i.e., 20:80 to 80:20). According to our study, however, the toner is liable to deteriorate an elastic layer surfacing a fixing roller and cause a denaturation of the binder resin during melt-kneading for preparing the toner because of a high content of the salicylic acid-based compound.

SUMMARY OF THE INVENTION

A generic object of the present invention is to provide a toner for developing electrostatic images having solved the above-mentioned problems.

A more specific object of the present invention is to provide a toner for developing electrostatic images showing a high charging speed in a low-humidity environment and retaining a high triboelectric charge in a high-humidity environment.

Another object of the present invention is to provide a toner for developing electrostatic images capable of suppressing the occurrence of fog and showing excellent continuous image forming characteristic on a large number of sheets.

Another object of the present invention is to provide a toner for developing electrostatic images having a high flowability and capable of providing high-quality images.

Another object of the present invention is to provide a toner for developing electrostatic images easily separable from carrier surfaces or the surface of an electrostatic image-bearing member while retaining a high triboelectric chargeability, thereby accomplishing a high image density and a high transferability in combination.

A further object of the present invention is to provide a toner for developing electrostatic images having an excellent negative triboelectric chargeability.

According to the present invention, there is provided a toner for developing electrostatic images, comprising: toner particles comprising (a) a binder resin, (b) a colorant or magnetic material, (c) an aromatic hydroxycarboxylic acid (A), and (d) a metal compound of the aromatic hydroxycarboxylic acid (A); wherein (c) the aromatic hydroxycarboxylic acid (A) and (d) the metal compound of the aromatic hydroxycarboxylic acid (A) are contained in a weight ratio of 1:99 to 10:90.

These and other objects, features and advantages of the present invention will become more apparent upon a consideration of the following description of the preferred embodiments of the present invention taken in conjunction with the accompanying drawing.

BRIEF DESCRIPTION OF THE DRAWING

A sole FIGURE in the drawing is an illustration of an apparatus for measuring toner triboelectric charge.

DETAILED DESCRIPTION OF THE INVENTION

A charge control agent influences the toner charging speed in a low-humidity environment, the triboelectric charge (ability) of the toner in a high-humidity environment, the toner flowability, etc.

A non-magnetic color toner is frequently blended with a magnetic carrier to provide a two-component type developer which is generally supplied to a developer-carrying member surface and carried thereon under the action of a magnetic force exerted by a magnet installed within the developer-carrying member to a developing zone, where an electrostatic image formed on an electrostatic image-bearing member is developer with the toner in the developer.

A toner image is transferred onto a recording transfer(-receiving) material (paper in most cases) to be fixed onto the transfer material under application of heat or/and pressure. During the development and transfer steps, the toner electrostatically carried on the carrier particle surfaces is moved to the electrostatic image-bearing member, and the toner image electrostatically carried on the electrostatic image-bearing member is electrostatically transferred to the transfer material via or without via an intermediate transfer member.

In the manner described above, the movement of toner during the development and transfer is started by separation of the toner overcoming the constraint of a Coulomb's force exerted by the carrier or the electrostatic image-bearing member. For the toner separation, it is desired that the Coulomb's force is reduced by diminishing the toner particle surface charge and the charge of polarity opposite to that of the toner on the carrier particle surface or the electrostatic image-bearing member surface to some extent at the time of contact therebetween.

By diminishing or canceling the opposite polarity charge, the developing performance and the transferability of the toner are improved, thereby accomplishing a high image density and a high image quality at a highlight image portion.

However, an excessive degree of charge diminishment results in lower triboelectric charges of the toner and the carrier at the time of mixing therebetween, thus being liable to cause the occurrence of fog and toner scattering during continuous image formation.

In the present invention, the above-mentioned problem has been solved by incorporating an aromatic hydroxycarboxylic acid (A) and a metal compound of the aromatic hydroxycarboxylic acid (A) at a weight ratio of 1:99 to 10:90 in toner particles.

Herein, a metal compound of an aromatic hydroxycarboxylic acid (A) refers to a compound having a bond between an oxygen atom of carboxyl group in the aromatic hydroxycarboxylic acid (A) and a metal. The bond refers to a chemical bond, such as an ionic bond, a covalent bond or a coordinate bond. It is possible that the aromatic hydroxycarboxylic acid (A) has a further bond with the metal at a part other than the carboxyl group.

A toner containing a metal compound of an organic acid as a charge control agent may have a relatively high triboelectric chargeability in some cases but is generally liable to show a lowering in triboelectric chargeability in a high-humidity environment. On the other hand, in a low-humidity environment, the toner is liable to show a lower charging speed.

This may be attributable to moisture adsorption and desorption near the metal atom such that the moisture adsorption to the metal compound is increased to result in a lower triboelectric charge in a high-humidity environment but is decreased to provide a higher resistivity and a lower charging speed in a low-humidity environment.

According to our study, it has been found possible to suppress the lowering in triboelectric chargeability in a high-humidity environment and the lowering in charging speed in a low-humidity environment by incorporating a specific proportion of an aromatic hydroxycarboxylic acid (A) in addition to the metal compound of the aromatic hydroxycarboxylic acid (A).

The mechanism of the improvement has not been fully clarified as yet, but the specific proportion of the aromatic hydroxycarboxylic acid may be assumed to control the moisture adsorption onto the metal compound.

The addition effect of the aromatic hydroxycarboxylic acid is however little unless the aromatic hydroxycarboxylic acid is identical in species to the aromatic hydroxycarboxylic acid constituting the metal compound. This may be attributable to the stability of the metal compound associated with the acid strength and symmetry of the aromatic hydroxycarboxylic acid.

It has been found possible to provide a high chargeability even in a high-humidity environment in the case of using a monoalkyl- or dialkyl-aromatic hydroxycarboxylic acid. This may be attributable to a small negative charge density of carboxyl group oxygen due to a resonance structure of the monoalkyl- or dialkyl-aromatic hydroxycarboxylic acid, so that the electron density on a metal is not raised excessively even if it is bonded with the metal, thus providing a metal compound showing a high negative charge density. Another factor may be a three-dimensionally large structure of the co-present monoalkyl- or dialkyl-substituted aromatic hydroxycarboxylic acid functioning to block water molecules. The valence and ionic radius of metal in the metal compound is correlated with the strength of bond with the aromatic hydroxycarboxylic acid, and a higher metal valence and a smaller ionic radius lead to a stronger bond with the aromatic hydroxycarboxylic acid, thus providing a metal compound of which the bond is less liable to be broken during production or long use of the toner and which is more stably fixed in the toner particles.

According to our study, the metal constituting the metal compound may preferably have a valence of two or more and an ionic radius of at most 0.8 Å (with reference to values listed in Table 15.23 at page 718 of "Kagaku Binran (Chemical Handbook) Revised Third Edition" edited by the Chemical Society of Japan).

Preferred examples of the metal include Al, Cr and Zn, and Al (III) is particularly preferred.

Preferred examples of the aromatic hydroxycarboxylic acid (A) may include salicylic acid, alkylsalicylic acid, dialkylsalicylic acid, and hydroxynaphthoic acid. Alkylsalicylic acid and dialkylsalicylic acid are further preferred. Preferred species of the alkylsalicylic acid include t-butylsalicylic acid and 5-tert-octylsalicylic acid, and the dialkylsalicylic acid may preferably be di-t-butylsalicylic acid. Di-t-butylsalicylic acid is particularly preferred as the aromatic hydroxycarboxylic acid (A).

The aromatic hydroxycarboxylic acid (A) and the metal compound of the aromatic hydroxycarboxylic acid (A) may be mixed in a weight ratio of 1:99 to 10:90, preferably 2:98 to 9:91. By the co-presence in the range, the moisture adsorption onto the metal compound can be effectively suppressed, thus suppressing the lowering in triboelectric chargeability of toner and toner scattering in the image forming apparatus in a high-humidity environment. On the other hand, in a low-humidity environment, the toner charging speed can be enhanced, so that it is possible to obtain good toner images from an initial stage of image formation. Further, in the above-mentioned range of mixing ratio, the toner can be provided with a sharp triboelectric charge distribution and an improved flowability. Further, in the case of polymerizing particles of a polymerizable monomer composition in an aqueous dispersion medium to directly prepare toner particles, the aromatic hydroxycarboxylic acid (A) added in a specific amount functions like a surfactant to provide the polymerizable monomer composition with an improved particle forming characteristic, thus providing toner particles having a sharp particle size distribution.

When the weight ratio of the aromatic hydroxycarboxylic acid (A) is below 1/99 relative to the metal compound of the aromatic hydroxycarboxylic acid (A), the addition effect thereof is little exhibited. When the ratio exceeds 10/90, the resultant toner shows a low charging speed in a low-humidity environment and is liable to soil the surface elastic layer of, e.g., silicone rubber, of a heating roller, thus resulting in a soiled elastic layer which is liable to be deteriorated and damaged. Further, if the weight ratio of the aromatic hydroxycarboxylic acid (A) exceeds 10/90, when it is melt-kneaded with polyester resin, the aromatic hydroxycarboxylic acid (A) can cause an ester exchange reaction with the polyester, so that the polyester resin can have a lower molecular weight to lower the anti-offset characteristic and the moisture resistance of the resultant toner.

In order to further stabilize the triboelectric chargeability of the toner under various environmental conditions including low temperature/low humidity, normal temperature/normal humidity and high temperature/high humidity, the metal compound of aromatic hydroxycarboxylic acid (A) may assume a mixture of metal compounds including different numbers of bonded aromatic hydroxycarboxylic acid molecules, respectively per metal atom. A metal compound (I) having a smaller number of bonded aromatic hydroxycarboxylic acid molecules, a metal compound (II) having a larger number of aromatic hydroxycarboxylic acid molecules, and the aromatic hydroxycarboxylic acid (A), may be in ratios of 20-80 : 80-20 : 1-10, more preferably 30-70 : 70-30 : 2-9. Specific examples of the metal compound of aromatic hydroxycarboxylic acid may include: zinc compound of di-tert-butylsalicylic acid, chromium compound of di-tert-butylsalicylic acid, zinc compound of 5-tert-octylsalicylic acid, chromium compound of 5-tert-octylsalicylic acid, and aluminum compound of 5-tert-octylsalicylic acid. Some example compounds may be represented by the following structural formulae wherein A denotes hydrogen, alkali metal element or alkaline earth metal element.

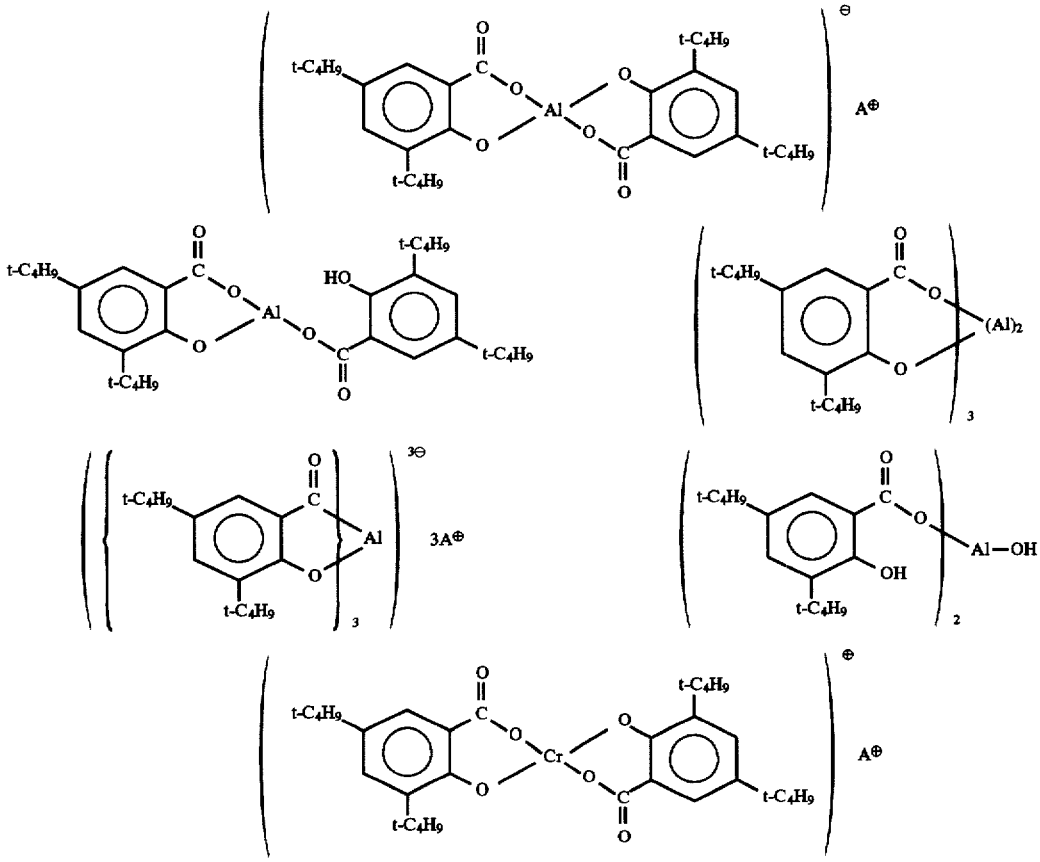

-continued

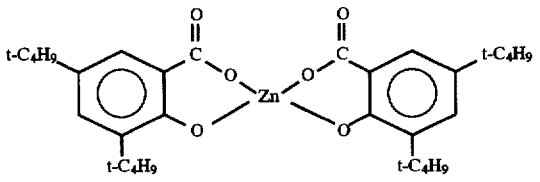

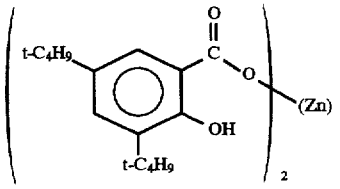

In the case of aluminum compounds, for example, there may be two types of aluminum compounds including one wherein two aromatic hydroxycarboxylic acid molecules are bonded to one aluminum atom, and the other wherein three aromatic hydroxycarboxylic acid molecules are bonded to two aluminum atoms. It is most preferred to use these two types in mixture in order to provide a toner having excellent environmental stability.

In order to well exhibit the above-mentioned effects, it is preferred that the toner particles contain the aromatic hydroxycarboxylic acid (A) in an amount of 0.05–1.5 wt. parts and the metal compound of the aromatic hydroxycarboxylic acid (A) in an amount of 0.45–13.5 wt. parts, respectively, per 100 wt. parts of the binder resin.

The binder resin for the toner of the present invention may for example comprise: homopolymers of styrene and derivatives thereof, such as polystyrene, poly-p-chlorostyrene and polyvinyltoluene; styrene copolymers such as styrene-p-chlorostyrene copolymer, styrene-vinyltoluene copolymer, styrene-vinylnaphthalene copolymer, styrene-acrylate copolymer, styrene-methacrylate copolymer, styrene-methyl α-chloromethacrylate copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer and styrene-acrylonitrile-indene copolymer; polyvinyl chloride, phenolic resin, natural resin-modified phenolic resin, natural resin-modified maleic acid resin, acrylic resin, methacrylic resin, polyvinyl acetate, silicone resin, polyester resin, polyurethane, polyamide resin, furan resin, epoxy resin, xylene resin, polyvinyl butyral, terpene resin, chmarone-indene resin and petroleum resin.

A crosslinked styrene copolymer and a crosslinked polyester resin are also preferred binder resins.

Examples of the comonomer constituting such a styrene copolymer together with styrene monomer may include other vinyl monomers inclusive of: monocarboxylic acids having a double bond and derivative thereof, such as acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile, and acrylamide; dicarboxylic acids having a double bond and derivatives thereof, such as maleic acid, butyl maleate, methyl maleate and dimethyl maleate; vinyl esters, such as vinyl chloride, vinyl acetate, and vinyl benzoate; ethylenic olefins, such as ethylene, propylene and butylene; vinyl ketones, such as vinyl methyl ketone and vinyl hexyl ketone; and vinyl ethers, such as vinyl methyl ether, vinyl ethyl ether, and vinyl isobutyl ether. These vinyl monomers may be used alone or in mixture of two or more species in combination with the styrene monomer.

The crosslinking agent may principally be a compound having two or more double bonds susceptible of polymerization, examples of which may include: aromatic divinyl compounds, such as divinylbenzene, and divinylnaphthalene; carboxylic acid esters having two double bonds, such as ethylene glycol diacrylate, ethylene glycol dimethacrylate and 1,3-butanediol dimethacrylate; divinyl compounds, such as divinylaniline, divinyl ether, divinyl sulfide and divinylsulfone; and compounds having three or more vinyl groups. These may be used singly or in mixture.

A binder resin principally comprising a styrene-acryl copolymer (i.e., a copolymer of styrene with an acrylic monomer, such as (meth)acrylate or (meth)acrylic acid) may preferably be one including a THF (tetrahydrofuran)-soluble content providing a molecular weight distribution by GPC (gel permeation chromatography) showing at least one peak in a molecular weight region of $3\times10^3$–$5\times10^4$ and at least one peak in a molecular weight region of at least $10^5$ and containing 50–90 wt. % of a component having a molecular weight of at most $10^5$. The binder resin may preferably have an acid value of 1–35 mgKOH/g.

A binder resin principally comprising a polyester resin may preferably have such a molecular weight distribution that it shows at least one peak in a molecular weight region of $3\times10^3$–$5\times10^4$ and contains 60–100 wt. % of a component having a molecular weight of at most $10^5$. It is further preferred to have at least one peak within a molecular weight region of $5\times10^3$–$2\times10^4$.

In the case of providing a non-magnetic color toner for full-color image formation, it is preferred to use a binder resin comprising a polyester. A polyester resin is excellent in fixability and clarity and is suitable for a color toner requiring good color mixing characteristic.

It is particularly preferred to use a polyester resin obtained by subjecting a diol comprising a bisphenol derivative represented by the following formula or a substitution derivative thereof:

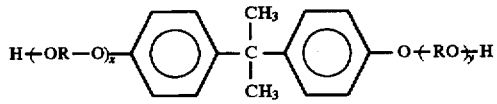

(wherein R denotes an ethylene or propylene group, x and y are independently a positive integer of at least 1 with the proviso that the average of x+y is in the range of 2–10); with a carboxylic acid component comprising a carboxylic acid having two or more functional groups (carboxylic groups), its anhydride or a lower alkyl ester thereof (e.g., fumaric acid, maleic acid, maleic anhydride, phthalic acid, terephthalic acid, trimellitic acid, pyromellitic acid) because of a sharp melting characteristic.

It is particularly preferred to use one having an apparent viscosity at 90° C. of $5\times10^4$–$5\times10^6$ poise, preferably $7.5\times10^4$–$2\times10^6$ poise, more preferably $10^5$–$10^6$ poise, and an apparent viscosity at 100° C. of $10^4$–$5\times10^5$ poise, preferably $10^4$–$3\times10^5$ poise, more preferably $10^4$–$2\times10^5$ poise, so as to provide a full-color toner having good fixability, color mixing characteristic and anti-high temperature offset characteristic. It is particularly preferred to use a polyester resin showing an apparent viscosity $P_1$, at 90° C. and an apparent viscosity $P_2$ at 100° C. providing a difference satisfying $2\times10^5<|P_1-P_2|<4\times10^6$.

It is further preferred to use a polyester resin having an acid value of 1–35 mgKOH/g, more preferably 1–20 mgKOH/g, further preferably 3–15 mgKOH/g, so as to provide a stable chargeability under various environmental conditions.

The colorants may include known chromatic and black to white pigments. Among these, an organic pigment having a high lipophilicity may be preferred.

Examples thereof may include: Naphthol Yellow S, Hansa Yellow G, Permanent Yellow NCG, Permanent Orange GTR, Pyrazolone Orange, Benzidine Orange G, Permanent Red 4R, Watching Red calcium salt, Brilliant Carmine 38, Fast Violet B, Methyl Violet Lake, Phthalocyanine Blue, Fast Sky Blue and Indanthrene Blue BC.

It is preferred to use a highly light-resistant pigment, e.g., of the polycondensed azo type, insoluble azo type, quinacridone type, isoindolinone type, perylene type, anthraquinone type and copper phthalocyanine type.

More specifically, magenta pigments may include: C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 202, 206, 207, 209, 238; C.I. Pigment Violet 19; C.I. Vat Red 1, 2, 10, 13, 15, 23, 29, 35.

Cyan pigments may include C.I. Pigment Blue 2, 3, 15, 16, 17; C.I. Vat Blue 6; C.I. Acid Blue 45; and copper phthalocyanine pigments represented by the following formula (1) and having a phthalocyanine skeleton and 1–5 phthalimide methyl groups as substituents:

(1)

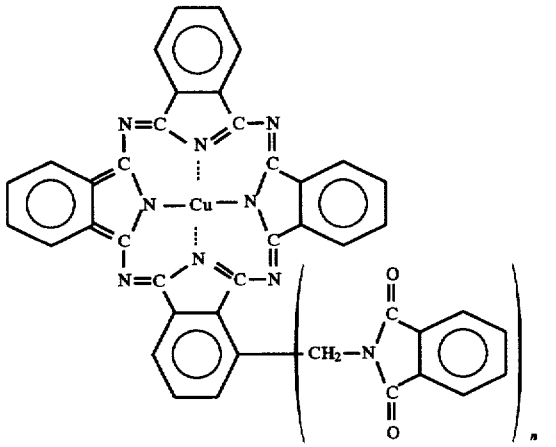

n = 1~5

Yellow pigments may include; C.I. Pigment Yellow 1, 2, 3, 4, 5, 6, 7, 10, 11, 12, 13, 14, 15, 16, 17, 23, 65, 73, 74, 81, 83, 93, 94, 95, 97, 98, 109, 120, 128, 138, 147, 151, 154, 166, 167, 173, 180, 181; C.I. Vat Yellow 1, 3, 20.

Black pigments may include carbon black, aniline black and acetylene black.

These non-magnetic colorants may preferably be used in an amount of 0.1–20 wt. parts per 100 wt. parts of the binder resin.

In the case of providing a magnetic toner, the toner particles contain a magnetic material which also functions as a colorant.

The magnetic material may for example comprise: iron oxides, such as magnetite, hematite and ferrite; metals, such as iron, cobalt and nickel, and alloys of these metals with a metal, such as aluminum, cobalt, copper, lead, magnesium, tin, zinc, antimony, beryllium, bismuth, cadmium, calcium, manganese, selenium, titanium, tungsten, or vanadium; and mixtures of the above.

The magnetic material may have an average particle size of at most 2 μm, preferably 0.1–0.5 μm, and may be contained in an amount of 20–200 wt. parts, more preferably 40–150 wt. parts, per 100 wt. parts of the binder resin.

The magnetic material may preferably have magnetic properties as measured by applying a magnetic field of 10 kilo-oersted, including a coercive force (Hc) of 20–300 oersted, a saturation magnetization ($\sigma_s$) of 50–200 emu/g, and a residual magnetization ($\sigma_r$) of 2–20 emu/g.

The toner according to the present invention can contain wax in order to have enhanced fixability and anti-offset characteristic.

The wax used in the present invention may include hydrocarbon wax, examples of which may include: a low-molecular weight alkylene polymer obtained by radical polymerization of alkylene under a high pressure; low-molecular weight alkylene polymer obtained by polymerization under a low pressure by using a Ziegler catalyst; low-molecular weight alkylene polymer obtained by thermal decomposition of high-molecular weight alkylene polymer; and low-molecular weight polymethylene obtained by hydrogenating distillation residue of hydrocarbons obtained from synthesis gas containing carbon monoxide and hydrogen through the Arge process. It is particularly preferred to use a hydrocarbon wax obtained by fractionating the above-mentioned hydrocarbon waxes into a particular fraction, e.g., by the press sweating method, the solvent method, the vacuum distillation and fractionating crystallization, for removing a low-molecular weight fraction or for collecting a low-molecular weight fraction.

Other types of waxes may include microcrystalline wax, carnauba wax, sasol wax, paraffin wax and ester wax.

The wax may preferably have a number-average molecular weight (Mn) of 500–1200 and a weight-average molecular weight (Mw) of 800–3600 when measured as equivalent to polyethylene. When the molecular weight is below the above-mentioned range, the resultant toner is caused to have inferior anti-blocking characteristic and developing performance. Above the above-mentioned molecular weight range, it becomes difficult to obtain a toner showing good fixability and anti-offset characteristic.

The wax may preferably have an Mw/Mn ratio of at most 5.0, more preferably at most 3.0.

The wax may effectively be contained in an amount of 0.5–10 wt. parts per 100 wt. parts of the binder resin in the case of a toner prepared through the melt-kneading-pulverization process.

For preparation of toner particles, the above-mentioned binder resin, colorant or magnetic material, aromatic hydroxycarboxylic acid (A), metal compound of aromatic hydroxycarboxylic acid (A) and other additives are sufficiently blended by a blender and the melt-kneaded to mutually dissolve the resinous materials and disperse therein the colorant or magnetic material by using a hot kneading machine, such as hot rollers, a kneader or an extruder, followed by cooling, solidification, pulverization and strict classification to obtain toner particles.

Toner particles may also be prepared through various methods including: a method wherein a melted mixture is sprayed in air by using a disk or melt-fluid nozzle as disclosed in JP-B 56-13945; a method of directly producing toner particles by suspension polymerization as disclosed in JP-B 36-10231, JP-A 59-53856 and JP-A 59-61842; a dispersion polymerization method for directly producing toner particles by using an aqueous solvent system wherein the monomer is soluble but the polymerizate is not soluble; and an emulsion polymerization method as represented by soap-free polymerization method wherein toner particles are directly produced by polymerization in the presence of a water-soluble polar polymerization initiator.

For example, a polymerizable monomer composition comprising at least a polymerizable monomer, a colorant or magnetic material, an aromatic hydroxycarboxylic acid (A), a metal compound of the aromatic hydroxycarboxylic acid (A) and a polymerization initiator is dispersed in an aqueous medium to form particles of the polymer composition, and the polymerizable monomer composition (more exactly the polymerizable monomer therein) is polymerized in the aqueous medium to form toner particles.

More specifically, the toner according to the present invention may particularly preferably be produced through the suspension polymerization process by which a particulate toner having a small particle size can be easily produced with a uniformly controlled shape and a sharp particle size distribution. It is also possible to suitably apply the seed polymerization process wherein once-obtained polymerizate particles are caused to adsorb a monomer, which is further polymerized in the presence of a polymerization initiator. It is also possible to include a polar compound in the monomer adsorbed by dispersion or dissolution.

In case where the toner according to the present invention is produced through the suspension polymerization, toner particles may be produced directly in the following manner. Into a polymerizable monomer, a colorant or magnetic material, an aromatic hydroxycarboxylic acid (A) and a metal compound of aromatic hydroxycarboxylic acid (A), a polymerization initiator and another optional additive are added and uniformly dissolved or dispersed by a homogenizer or an ultrasonic dispersing device, to form a polymerizable monomer composition, which is then dispersed and formed into particles in a dispersion medium containing a dispersion stabilizer by means of an ordinary stirrer, a homomixer or a homogenizer preferably under such a condition that droplets of the polymerizable monomer composition can have a desired particle size of the resultant toner particles by controlling stirring speed and/or stirring time. Thereafter, the stirring may be continued in such a degree as to retain the particles of the polymerizable monomer composition thus formed and prevent the sedimentation of the particles. The polymerization may be performed at a temperature of at least 40° C., generally 50°–90° C. The temperature can be raised at a later stage of the polymerization. It is also possible to subject a part of the aqueous system to distillation in a latter stage of or after the polymerization in order to remove the yet-unpolymerized part of the polymerizable monomer and a by-product which can cause an odor in the toner fixation step. After the reaction, the produced toner particles are washed, filtered out, and dried. In the suspension polymerization, it is generally preferred to use 300–3000 wt. parts of water as the dispersion medium per 100 wt. parts of the monomer composition.

In production of toner particles by the suspension polymerization using a dispersion stabilizer, it is preferred to use an inorganic or/and an organic dispersion stabilizer in an aqueous dispersion medium. Examples of the inorganic dispersion stabilizer may include: tricalcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica, and alumina. Examples of the organic dispersion stabilizer may include: polyvinyl alcohol, gelatin, methyl cellulose, methyl hydroxypropyl cellulose, ethyl cellulose, carboxymethyl cellulose sodium salt, and starch. These dispersion stabilizers may preferably be used in the aqueous dispersion medium in an amount of 0.2–2.0 wt. parts per 100 wt. parts of the polymerizable monomer mixture.

In the case of using an inorganic dispersion stabilizer, a commercially available product can be used as it is, but it is also possible to form the stabilizer in situ in the dispersion medium so as to obtain fine particles thereof. In the case of tricalcium phosphate, for example, it is adequate to blend an aqueous sodium phosphate solution and an aqueous calcium chloride solution under an intensive stirring to produce tricalcium phosphate particles in the aqueous medium, suitable for suspension polymerization. In order to effect fine dispersion of the dispersion stabilizer, it is also effective to use 0.001–0.1 wt. % of a surfactant in combination, thereby promoting the prescribed function of the stabilizer. Examples of the surfactant may include: sodium dodecylbenzenesulfonate, sodium tetradecyl sulfate, sodium pentadecyl sulfate, sodium octyl sulfate, sodium oleate, sodium laurate, potassium stearate, and calcium oleate.

Examples of the polymerizable monomer may include: styrene; styrene derivatives, such as o-methylstyrene, p-methylstyrene, p-methoxystyrene, and p-ethylstyrene; acrylic acid esters, such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate, and phenyl acrylate; methacrylic acid esters, such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate, acrylonitrile, methacrylonitrile, and acrylamide. These monomers may be used singly or in combination of two or more species. It is particularly preferred to use styrene monomer and an acrylic monomer in combination.

It is possible to incorporate a polymer or copolymer having a polar group into a monomer composition for polymerization.

Examples of such polar polymer and polar copolymer may include: polymers of nitrogen-containing monomers, such as dimethylaminoethyl methacrylate, and diethylaminoethyl methacrylate; copolymers of such nitrogen-containing monomers with styrene and/or unsaturated carboxylic acid esters; homopolymers and copolymers with, e.g., styrene, of polar monomers, inclusive of halogen-containing monomers, such as vinyl chloride; unsaturated carboxylic acids such as acrylic acid and methacrylic acid; unsaturated dibasic acids, unsaturated dibasic acid anhydrides, and nitro group-containing monomers; polyesters and epoxy resins.

It is particularly preferred to use a polyester resin or a styrene-acryl copolymer each having an acid value of 1–35 mgKOH/g as a polar resin.

Examples of the polymerization initiator may include: azo- or diazo-type polymerization initiators, such as 2,2'-azobis-(2,4-dimethylvaleronitrile), 2,2'-azobisisobutylonitrile, 1,1'-azobis(cyclohexane-2-carbonitrile), 2,2'-azobis-4-methoxy-2,4-dimethylvaleronitrile, and azobisisobutyronitrile; peroxide-type polymerization initiators, such as benzoyl peroxide, methyl ethyl ketone peroxide, diisopropyl peroxycarbonate, cumene hydroperoxide, t-butyl hydroperoxide, di-t-butyl peroxide, dicumyl peroxide, 2,4-dichlorobenzoyl peroxide, lauroyl peroxide, 2,2-bis(4,4-t-butylperoxycyclohexyl) propane, and tris(t-butylperoxy)triazine, and polymeric initiators having a peroxide group in its side chain; persulfates, such as potassium persulfate, and ammonium persulfate; and hydrogen peroxide. These polymerization initiators may be used singly or in combination of two or more species.

The polymerization initiator may preferably be added in an amount of 0.5–20 wt. parts per 100 wt. parts of the polymerizable monomer.

In order to control of the molecular weight of the resultant polymer, it is possible to add a crosslinking agent and/or a chain transfer agent in an amount of preferably 0.001–15 wt. parts.

In the case of preparing toner particles by suspension polymerization, wax may be added to the monomer composition so as to be contained or encapsulated within the resultant toner particles. In that case, it is preferred to add the wax in an amount of 1 to 40 wt. parts, more preferably 5–35 wt. parts, further preferably 10–30 wt. parts, per 100 wt. parts of the polymerizable monomer.

By dissolving a free aromatic hydroxycarboxylic acid (A) in addition to a metal compound of aromatic hydroxycarboxylic acid (A) in the monomer composition, the dispersion of the monomer composition into particles in an aqueous medium can be facilitated been if a large amount of wax is contained therein, thereby producing toner particles having a sharper particle size distribution.

To the toner particles, it is sometimes preferred to add external additives, inclusive of: lubricant powder, such as teflon powder, zinc stearate powder and polyvinylidene fluoride powder; abrasives, such as cerium oxide, silicon carbonate, and strontium titanate; flowability improvers, such as silica, titanium oxide and aluminum oxide; anticaking agent; and electroconductivity imparting agents, such as carbon black, zinc oxide, and tin oxide.

The flowability improver may preferably comprise: fine powder of an inorganic substance, such as silica, titanium oxide or aluminum oxide. The inorganic fine powder may preferably be hydrophobized (i.e., hydrophobicity-imparted) with a hydrophobizing agent, such as a silane coupling agent or/and silicone oil.

The external additive may be added in an amount of 0.1–5 wt. parts per 100 wt. parts of the toner particles.

In case where the toner particles are non-magnetic color toner particles for full-color image formation, it is preferred to add titanium oxide particles as an external additive. It is particularly prepared to use titanium oxide particles, surface-treated with a silane coupling agent, for imparting stable chargeability and flowability to the toner particles. This effect is not accomplished by a conventional flowability improver of hydrophobic silica alone.

This may be attributable to a difference that silica fine particles per se are strongly negatively chargeable and titanium fine particles have a substantially neutral chargeability.

As a result of detailed study regarding stabilization of toner chargeability, it has been found particularly effective in stabilization of chargeability and improvement in flowability of the resultant toner to use titanium oxide fine powder treated with a coupling agent and having an average particle size of 0.01–0.2 μm, more preferably 0.01–0.1 μm, further preferably 0.01–0.07 μm, a hydrophobicity of 20–98%, and a light transmittance of at least 40% at a wavelength of 400 nm.

The coupling agent may include a silane coupling agent and a titanate coupling agent. A silane coupling agent is preferred, and a preferred class thereof may be represented by the formula: $R_mSiY_n$, wherein Y denotes a hydrocarbon group such as alkyl or vinyl, glycidoxy or methacryl; and m and n are respectively an integer of 1–3 satisfying m+n=4. Preferred examples of the silane coupling agent may include: vinyltrimethoxysilane, vinyltriethoxysilane, γ-methacryloxypropyltrimethoxysilane, vinyltriacetoxysilane, methyltrimethoxysilane, methyltriethoxysilane, isobutyltrimethoxysilane, dimethyldimethoxysilane, dimethyldiethoxysilane, trimethylmethoxysilane, hydroxypropyltriethoxysilane, phenyltrimethoxysilane, n-hexadecyltrimethoxysilane, and n-octadecyltrimethoxysilane. A particularly preferred class of the silane coupling may be represented by the following formula:

$$C_\alpha H_{2\alpha+1}—Si(OC_\beta H_{2\beta+1})_3,$$

wherein α denotes an integer of 4–12 and β denotes an integer of 1–3. If a is below 4, the hydrophobization treatment becomes easy but the resultant hydrophobicity is liable to be low. In case of a larger than 12, the resultant hydrophobicity is sufficient but the treated titanium oxide particles are liable to coalesce with each other to result in a lower flowability. β larger than 3 is liable to provide a lower reactivity and thus fail in hydrophobization. It is further preferred that α is 4–8 and β is 1–2.

The titanium oxide fine powder in 100 wt. parts may be treated with 1–50 wt. parts, preferably 3–40 wt. parts, of the silane coupling agent.

The treated titanium oxide may have a hydrophobicity of 20–98%, preferably 30–90% more preferably 40–80%. If the hydrophobicity is below 20%, the resultant toner is liable to have a lower chargeability in a long period of standing in a high-humidity environment. If the hydrophobicity exceeds 98%, the charge control of the titanium oxide per se becomes difficult, thus being liable to cause a charge-up (excessive charge) of the toner in a low-humidity environment.

The hydrophobic titanium oxide fine powder may preferably have an average particle size of 0.01–0.2 μm, more preferably 0.01–0.1 μm, further preferably 0.01–0.07 μm. The particle size exceeding 0.2 μm provides a lower flowability, and below 0.01 μm, the powder is liable to be embedded at the toner particle surfaces, thus lowering the continuous image forming performances. This liability is more pronounced in a color toner having a sharp melting characteristic. The particle size of the titanium oxide referred to herein is based on results obtained by observation through a transmission type electron microscope.

It is preferred that the treated titanium oxide powder shows a light transmittance at a wavelength of at least 40% for the following reason.

The titanium oxide preferably used in the present invention may have a primary particle size of 0.01–0.2 μm. However, it is not necessarily dispersed in primary particles in the toner but can be present in secondary particles. Accordingly, if the effective size of secondary particles is large even if the primary particle size is small, the addition effect thereof is remarkably lowered. Titanium oxide showing a high light transmittance at 400 nm (lower limit of visible region) when dispersed in liquid means a smaller secondary particle size giving good performances in flowability-improving effect and providing clearer OHP projected images of a color toner. The wavelength of 400 nm has been selected because light having a wavelength is known to be transmitted through particles having a particle size which is below a half of the wavelength so that light having a larger wavelength naturally has a larger transmittance and has little importance.

For the purpose of obtaining hydrophobic titanium oxide particles, it is also preferred to adopt a process wherein volatile titanium alkoxide, etc., is oxidized at a low temperature to form spherical titanium oxide, which is then surface-treated to provide amorphous spherical titanium oxide.

A toner of a smaller particle size has a larger surface area of toner particles per unit weight and is liable to be excessively triboelectrically charged. Hydrophobic titanium oxide fine powder is preferred as an external additive for small particle size toner particles because it provides a good flowability to the toner while suppressing excessive triboelectric charge of the toner.

Further, hydrophobic titanium oxide fine powder externally added to toner particles has a capacity of absorbing silicone oil which is attached to the surface of a color toner image at the time of fixation than hydrophobic silica fine powder so that, in the case of double-side image formation, the staining of a transfer drum contacting a front face toner image at the time of image formation on a back side with silicone oil is suppressed and also the staining of the transfer drum contacting the transfer drum with the silicone oil is also suppressed.

It is preferred that the toner particles are blended with 0.5–5 wt. %, more preferably 0.7–3 wt. %, further preferably 1.0–2.5 wt. %, of hydrophobic titanium oxide.

The toner particles and the external additive may suitably be blended by using a blender such as a Henschel mixer.

In the case where the toner according to the present invention is used to constitute a two-component developer, the toner may be blended with a magnetic carrier. The magnetic carrier may for example comprise particles of metal, such as surface-oxidized or -unoxidized iron, nickel, copper, zinc, cobalt, manganese, chromium, and rare earth metals, and alloys of these metals, oxide particles and ferrite particles.

A coated carrier obtained by coating magnetic carrier particles as described above with a resin may particularly preferably be used in a developing method wherein an AC bias voltage is applied to a developing sleeve. The coating may be performed by known methods including a method wherein a coating liquid obtained by dissolving or dispersing a coating material such as a resin is applied onto the surfaces of magnetic carrier core particles, and a method of powder-blending the magnetic carrier core particles and a coating material.

Examples of the coating material on the magnetic carrier core particles may include: silicone resin, polyester resin, styrene resin, acrylic resin, polyamide, polyvinyl butyral, and aminoacrylate resin. These may be used singly or in combination of two or more species.

The coating material may be applied in an amount of 0.1–30 wt. %, preferably 0.5–20 wt. %, based on the carrier core particles. The carrier may preferably have an average particle size of 10–100 μm, more preferably 20–70 μm.

A two-component type developer may suitably be prepared by blending the toner according to the present invention with a magnetic carrier so as to provide a toner concentration therein of 2–15 wt. %, preferably 4–13 wt. %. Below 2 wt. %, the image density is liable to be lowered. Above 15 wt. %, fog and toner scattering within the apparatus are liable to occur.

The carrier may preferably have magnetic properties including a magnetization at 1000 oersted ($\sigma_{1000}$) after magnetic saturation of 30–300 emu/g, more preferably 100–250 emu/g, for high-quality image formation. Above 300 emu/g, it becomes difficult to obtain high-quality toner images. Below 30 emu/g, the magnetic constraint force is lowered, thus being liable to cause carrier attachment.

The carrier may preferably have shape factors SF-1 (representing a roundness) of at most 180 and SF-2 (representing a degree of roughness) of at most 250 as calculated by the following equations:

$$SF\text{-}1=(\text{maximum length/area})\times(\pi/4)\times 100$$

$$SF\text{-}2=(\text{peripheral length/area})\times(\pi/4)\times 100.$$

For measurement, sample carrier particles are taken in photographs through a scanning electron microscope. About 100 particles are selected at random on photographs, and "maximum length", "peripheral length" and "area" (projection area) of carrier particles, respectively on an average, are measured by using an image analyzer ("Luzex III", available from Nireco K.K.) and used to calculate SF-1 and SF-2 according to the above equations.

The methods for measuring the triboelectric chargeability, particle size distribution, apparent viscosity, hydrophobicity and flowability of a toner, etc., referred to herein are described hereinbelow.

Triboelectric charge (TC) in various environments

A sample toner and a carrier are left standing one whole day in an environment concerned, such as a high temperature/high humidity environment (80° C./80%RH) or a low temperature/low humidity environment (20° C./20%RH), and then subjected to measurement according to the blow-off method in the below-described manner.

An apparatus as shown in the sole figure is used for measurement of a triboelectric charge(ability) of a toner. First, a mixture of a sample toner and a carrier in a weight ratio of 1:19 is placed in a polyethylene bottle of 50–100 ml in volume, and the bottle is shaked for 5–10 min. by hands. Then, ca. 0.5–1.5 g of the mixture (developer) is taken and placed in a metal measurement vessel 2 equipped with 50 mesh-screen 3 at its bottom, and the vessel is covered with a metal lid 4. The total weight ($W_1$ g) of the measurement vessel at this time is measured. Then, an aspirator 1 (of which the portion contacting the vessel 2 is insulating) is operated by sucking through a suction outlet 7 while adjusting an air control valve 6 to provide a pressure of 250 mmAq at a vacuum gauge 5. In this state, the aspiration is sufficiently performed, preferably about 2 min., to remove the toner by sucking. The potential on a potential meter 9 connected to the vessel 2 via a capacitor 8 (having a capacitance CUF) is read at V volts. The total weight ($W_2$ g) after the aspiration is measured, and the triboelectric charge of the toner is calculated according to the following equation:

$$\text{Triboelectric charge (mC/kg)}=CxV/(W_1-W_2).$$

Toner particle size distribution

Coulter Counter TA-II or Coulter Multisizer II (available from Coulter Electronics Inc.) is used together with an electrolytic solution comprising a ca. 1% NaCl aqueous solution which may be prepared by dissolving a reagent-grade sodium chloride or commercially available as "ISOTON-II" (from Counter Scientific Japan).

For measurement, into 10 to 150 ml of the electrolytic solution, 0.1 to 5 ml of a surfactant (preferably an alkyl benzenesulfonic acid salt) is added as a dispersant, and 2–20 mg of a sample is added. The resultant dispersion of the sample in the electrolytic solution is subjected to a dispersion treatment by an ultrasonic disperser for ca. 1–3 min., and then subjected to measurement of particle size distribution by using the above-mentioned apparatus equipped with a 100 μm-aperture. The volume and number of toner particles are measured for respective channels to calculate a volume-basis distribution and a number-basis distribution of the toner. From the volume-basis distribution, a weight-average particle size ($D_4$) of the toner is calculated by using a central value as a representative for each channel.

The channels used include 13 channels of 2.00–2.52 μm; 2.52–3.17 μm; 3.17–4.00 μm; 4.00–5.04 μm; 5.04–6.35 μm; 6.35–8.00 μm; 8.00–10.08 μm, 10.08–12.70 μm; 12.70–16.00 μm; 16.00–20.20 μm; 20.20–25.40 μm; 25.40–32.00 μm: and 32.00–40.30 μm.

Apparent viscosity (Vap)

Flow Tester ("CFT-500", available from Shimazu Seisakusho K.K.) is used. Ca. 1.0–1.5 g of 60 mesh-pass sample is weighed and shaped under a pressure of 100 kg/cm$^2$ for 1 min.

The shaped sample is subjected to the flow tester measurement under normal temperature—normal humidity conditions (ca. 20°–30° C. and 30–70%RH) to obtain a temperature-apparent viscosity curve. From a smoothened curve, apparent viscosities at 90° C. and 100° C. are read. The setting parameters of the flow tester are as follows.

| | |
|---|---|
| RATE TEMP | 6.0 D/M (°C./min.) |
| STE TEMP | 70.0 DEG (°C.) |
| MAX TEMP | 200.0 DEG |
| INTERVAL | 3.0 DEG |
| PREHEAT | 300.0 SEC (sec.) |
| LOAD | 20.0 KGF (kg) |
| DIE (DIA) | 1.0 MM (mm) |
| DIE (LENG) | 1.0 MM |
| PLUNGER | 1.0 CM$^2$ (cm$^2$) |

Hydrophobicity ($H_{MeOH}$)

A methanol titration test is performed in the following manner as an experimental test for evaluating the hydrophobicity of a powder sample (e.g., titanium oxide fine powder having a hydrophobized surface).

0.2 g of a sample powder is added to 50 ml of water in a vessel. While continuously stirring the liquid in the vessel with a magnetic stirrer, methanol is added to the vessel from a buret until the whole sample powder is wetted with the liquid (water+methanol mixture) in the vessel. The end point can be confirmed by the suspension of the total amount of the sample powder. The hydrophobicity is given as the percentage of methanol in the methanol-water mixture on reaching the end point.

Flowability (Dag)

The flowability of a toner may be evaluated by an agglomeratability of the toner measured in the following manner.

The agglomeratability of a sample toner is measured by using a powder tester (available from Hosokawa Micron K.K.). On a vibration table, a 400 mesh-sieve, a 200 mesh-sieve and a 100 mesh-sieve are set in superposition in this order. On the set sieves, 5 g of a sample toner is placed, and the sieves are vibrated for 15 sec. Then, the weights of the toner remaining on the respective sieves are measured to calculate the agglomeratability according to the following formula:

$$\text{Agglomeratability } (\%)=(a/5+(b/5)\times(3/5)+(c/g)\times(1/5))\times 100,$$

wherein a: weight of toner on 100 mesh-sieve (g)

b: weight of toner on 200 mesh-sieve (g)

c: weight of toner on 400 mesh-sieve (g).

A lower agglomeratability represents a higher flowability of toner.

Acid value (AV) (JIS-acid value)

1) Ca. 0.1–0.2 g of a sample is accurately weighed to record its weight at W (g).

2) The sample is placed in an Erlenmeyer flask and 100 cc of a toluene/ethanol (2/1) mixture solution is added thereto to dissolve the sample.

3) Several drops of phenolphthalein alcohol solution is added as an indicator.

4) The solution in the flask is titrated with a 0.1N-KOH alcohol solution from a buret.

The amount of the KOH solution used for the titration is denoted by S (ml). A blank test is performed in parallel to determine the amount of the KOH solution for the blank titration at B (ml).

5) The acid value of the sample is calculated by the following formula:

Acid value=(S–B)×f×5.61/W, wherein f denotes a factor of the KOH solution.

Production Example 1 for Aluminum Compound

Aqueous solution of 0.5 mol of NaOH and 0.4 mol of di-tert-butylsalicylic acid were mixed and heated for dissolution. The resultant solution and 0.1 mol of $Al_2(SO_4)_3$ in aqueous solution were mixed and heated under stirring. Then, the resultant white precipitate at a neutral or weak alkaline condition was recovered by filtration and washed with water until the washing liquid became neutral. Then, the precipitate was dried to obtain fine powdery Aluminum Compound 1 having two di-tert-butyl salicylic acid molecules bonded to one aluminum atom.

Production Example 2 for Aluminum Compound

Aqueous solution of 0.3 mol of NaOH and 0.3 mol of di-tert-butyl salicylic acid were mixed and heated for dissolution. The resultant solution and 0.1 mol of $Al_2(SO_4)_3$ in aqueous solution were mixed and heated under stirring, followed by adjustment of the solution to neutral to weak alkaline state. The resultant white precipitate was recovered by filtration and washed with hot water, followed by drying to obtain fine powdery Aluminum Compound 2 having three di-tert-butylsalicylic acid molecules bonded to two aluminum atoms.

Production Example 3 for Aluminum Compound

Fine powdery Aluminum Compound 3 was prepared in the same manner as in Production Example 1 except for using 3-hydroxynaphthalene-2-carboxylic acid instead of the di-tert-butylsalicylic acid.

Production Example 4 for Aluminum Compound

Fine powdery Aluminum Compound 3 was prepared in the same manner as in Production Example 1 except for using 5-tert-octylsalicylic acid instead of the di-tert-butylsalicylic acid.

Production Example for Chromium Compound

Aqueous solution of 0.4 mol of NaOH and 0.4 mol of di-tert-butyl salicylic acid were mixed and heated for dissolution. The resultant solution and 0.1 mol of $Cr_2(SO_4)_3$ in aqueous solution were mixed and heated under stirring, followed by adjustment of the solution to neutrally. The resultant white precipitate was recovered by filtration and washed with hot water, followed by drying to obtain fine powdery Chromium Compound having two di-tertbutylsalicylic acid molecules bonded to one chromium atom.

Production Example for Zinc Compound

Aqueous solution of 0.2 mol of NaOH and 0.2 mol of di-tert-butyl salicylic acid were mixed and heated for dissolution. The resultant solution and 0.1 mol of $ZnCl_2$ in aqueous solution were mixed and heated under stirring, followed by adjustment of the solution to neutral to weak alkaline state. The resultant white precipitate was recovered by filtration and washed with hot water, followed by drying to obtain fine powdery Zinc Compound having two di-tert-butylsalicylic acid molecules bonded to one zinc atoms.

Production Example 1 for Charge Controller Composition

Into 50 wt. parts of methyl alcohol solution containing 5 wt. parts of di-tert-butylsalicylic acid, 45 wt. parts of Aluminum Compound 1 and 50 wt. parts of Aluminum Compound 2 were dispersed. After sufficient mixing, the resultant dispersion was dried by spray-drying to obtain Charge Controller Composition 1.

Production Example 2 for Charge Controller Composition

Into 50 wt. parts of methyl alcohol solution containing 8 wt. parts of di-tert-butylsalicylic acid, 42 wt. parts of Aluminum Compound 1 and 50 wt. parts of Aluminum Compound 2 were dispersed. After sufficient mixing, the resultant dispersion was dried by spray-drying to obtain Charge Controller Composition 2.

Production Example 3 for Charge Controller Composition

Into 50 wt. parts of methyl alcohol solution containing 2 wt. parts of di-tert-butylsalicylic acid, 48 wt. parts of Aluminum Compound 1 and 50 wt. parts of Aluminum Compound 2 were dispersed. After sufficient mixing, the resultant dispersion was dried by spray-drying to obtain Charge Controller Composition 3.

Production Example 4 for Charge Controller Composition (Comparative)

Into 50 wt. parts of methyl alcohol solution containing 20 wt. parts of di-tert-butylsalicylic acid, 30 wt. parts of Aluminum Compound 1 and 50 wt. parts of Aluminum Compound 2 were dispersed. After sufficient mixing, the resultant dispersion was dried by spray-drying to obtain Charge Controller Composition 4.

Production Example 5 for Charge Controller Composition (Comparative)

Into 50 wt. parts of methyl alcohol solution containing 0.5 wt. part of di-tert-butylsalicylic acid, 49.5 wt. parts of Aluminum Compound 1 and 50 wt. parts of Aluminum Compound 2 were dispersed. After sufficient mixing, the resultant dispersion was dried by spray-drying to obtain Charge Controller Composition 5.

Production Example 6 for Charge Controller Composition (Comparative)

Into 50 wt. parts of methyl alcohol solution containing 5 wt. parts of 3-hydroxynaphthalene-2-carboxylic acid, 95 wt. parts of Aluminum Compound 1was dispersed. After sufficient mixing, the resultant dispersion was dried by spray-drying to obtain Charge Controller Composition 6.

Production Example 7 for Charge Controller Composition (Comparative)

Into 50 wt. parts of methyl alcohol solution containing 5 wt. parts of 3-hydroxynaphthalene-2-carboxylic acid, 95 wt. parts of Aluminum Compound 2 was dispersed. After sufficient mixing, the resultant dispersion was dried by spray-drying to obtain Charge Controller Composition 7.

Production Example 8 for Charge Controller Composition

Into 50 wt. parts of methyl alcohol solution containing 5 wt. parts of di-tert-butylsalicylic acid, 1 wt. part of Aluminum Compound 1 and 94 wt. parts of Aluminum Compound 2 were dispersed. After sufficient mixing, the resultant dispersion was dried by spray-drying to obtain Charge Controller Composition 8.

Production Example 9 for Charge Controller Composition

Into 50 wt. parts of methyl alcohol solution containing 5 wt. parts of di-tert-butylsalicylic acid, 94 wt. parts of Aluminum Compound 1 and 1 wt. part of Aluminum Compound 2 were dispersed. After sufficient mixing, the resultant dispersion was dried by spray-drying to obtain Charge Controller Composition 9.

Production Example 10 for Charge Controller Composition

Into 50 wt. parts of methyl alcohol solution containing 5 wt. parts of di-tert-butylsalicylic acid, 95 wt. parts of Aluminum Compound 1 was dispersed. After sufficient mixing, the resultant dispersion was dried by spray-drying to obtain Charge Controller Composition 10.

Production Example 11 for Charge Controller Composition

Into 50 wt. parts of methyl alcohol solution containing 5 wt. parts of di-tert-butylsalicylic acid, 95 wt. parts of Aluminum Compound 2 was dispersed. After sufficient mixing, the resultant dispersion was dried by spray-drying to obtain Charge Controller Composition 11.

Production Example 12 for Charge Controller Composition

Into 50 wt. parts of methyl alcohol solution containing 5 wt. parts of 3-hydroxynaphthalene-2-carboxylic acid, 95 wt. parts of Aluminum Compound 3 was dispersed. After sufficient mixing, the resultant dispersion was dried by spray-drying to obtain Charge Controller Composition 12.

Production Example 13 for Charge Controller Composition

Into 50 wt. parts of methyl alcohol solution containing 5 wt. parts of 5-tert-octylsalicylic acid, 95 wt. parts of Aluminum Compound 4 was dispersed. After sufficient mixing, the resultant dispersion was dried by spray-drying to obtain Charge Controller Composition 13.

Production Example 14 for Charge Controller Composition

Into 50 wt. parts of methyl alcohol solution containing 5 wt. parts of di-tert-butylsalicylic acid, 95 wt. parts of Chromium Compound was dispersed. After sufficient mixing, the resultant dispersion was dried by spray-drying to obtain Charge Controller Composition 14.

Production Example 15 for Charge Controller Composition

Into 50 wt. parts of methyl alcohol solution containing 5 wt. parts of di-tert-butylsalicylic acid, 95 wt. parts of Zinc Compound was dispersed. After sufficient mixing, the resultant dispersion was dried by spray-drying to obtain Charge Controller Composition 15.

The thus-obtained Charge Controller Compositions 1–15 are summarized in the following Table 1.

TABLE 1

| Charge controller composition | Metal compound (I) (wt. parts) | Metal compound (II) (wt. parts) | Aromatic hydroxy-carboxylic acid* (wt. parts) |
|---|---|---|---|
| 1 | Aluminum compound 1 (45) | Aluminum compound 2 (50) | DTBSA (5) |
| 2 | Aluminum compound 1 (42) | Aluminum compound 2 (50) | DTBSA (8) |
| 3 | Aluminum compound 1 (48) | Aluminum compound 2 (50) | DTBSA (2) |
| 4 (Comparative) | Aluminum compound 1 (30) | Aluminum compound 2 (50) | DTBSA (20) |
| 5 (Comparative) | Aluminum compound 1 (49.5) | Aluminum compound 2 (50) | DTBSA (0.5) |
| 6 (Comparative) | Aluminum compound 1 (95) | — | 3HN2CA (5) |
| 7 (Comparative) | — | Aluminum compound 2 (95) | 3HN2CA (5) |
| 8 | Aluminum compound 1 (1) | Aluminum compound 2 (94) | DTBSA (5) |
| 9 | Aluminum compound 1 (94) | Aluminum compound 2 (1) | DTBSA (5) |
| 10 | Aluminum compound 1 (95) | — | DTBSA (5) |
| 11 | — | Aluminum compound 2 (95) | DTBSA (5) |
| 12 | Aluminum compound 3 (95) | — | 3HN2CA (5) |
| 13 | Aluminum compound 4 (95) | — | 5TOSA (5) |
| 14 | Chromium compound (95) | — | DTBSA (5) |
| 15 | Zinc compound (95) | — | DTBSA (5) |

*DTBSA = di-tert-butylsalicylic acid
3HN2CA = 3-hydroxynaphthalene-2-carboxylic acid
5TOSA = 5-tert-octylsalicylic acid

EXAMPLE 1

| | |
|---|---|
| Polyester resin (AV (acid value) = 8)** | 100 wt. parts |
| Photocyanine pigment (C.I. Pigment Blue 15:3) | 4 wt. parts |
| Charge Controller Composition 1 | 5 wt. parts |

**A polyester resin prepared by polycondensation of polyoxypropylene (2,2)-2,2-bis(4-hydroxyphenyl)propane with fumaric acid and 1,2,5-hexane-tricarboxylic acid.

The above ingredients were subjected to sufficient preliminary blending by a Henschel mixer and melt-kneaded through a twin-screw extrusion kneader at ca. 140° C., followed by cooling, coarse crushing by a hammer mill into ca. 1–2 mm and fine pulverization by an air jet mill. The resultant fine pulverizate was classified to obtain cyan toner particles having a weight-average particle size ($D_4$) of 5.8 μm.

On the other hand, 100 wt. parts of hydrophilic titanium oxide fine powder (Dav (average particle size)=0.2 μm, $S_{BET}$ (BET specific surface area)=140 $m^2/g$) was surface-treated with 20 wt. parts of n-$C_4H_9$—$Si(OCH_3)_3$ to obtain hydrophobic titanium oxide fine powder (Dav=0.02 μm, $H_{MeOH}$ (hydrophobicity)=70%).

98.5 wt. parts of the cyan toner particles and 1.5 wt. parts of the hydrophilic titanium oxide fine powder were blended to prepare Cyan Toner 1 having the hydrophobic titanium oxide fine powder carried on the cyan toner particles. Cyan Toner 1 showed apparent viscosities (Vap) of $5\times10^5$ poise at 90° C. and $5\times10^4$ poise at 100° C.

5 wt. parts of the above Cyan Toner 1 and 95 wt. parts of coated magnetic ferrite carrier coated with ca. 1 wt. % of silicone resin (Dav=50 μm) were blended to prepare a two-component type developer.

The two-component type developer was charged in a full-color digital copying machine ("CLC-800", available from Canon K.K.) and used for a mono color-mode continuous image formation at a contrast potential of 250 volts while replenishing the toner as necessary and by using an original having an image area occupation ratio of 25% under different environments of normal temperature/normal humidity (23° C./60%RH), high temperature/high humidity (30° C./80%RH), normal temperature/normal humidity (23° C./10%RH) and low temperature/low humidity (15° C./10%RH). The continuous image formation was performed on 10000 sheets in each of the different environments. The results are inclusively shown in Tables 2-1 to 2-4.

Further, the copying machine was inspected after the continuous image formation, whereby the hot roller surface layer (silicone rubber layer) of the hot-pressure fixing device in the copying machine showed little deterioration and little trace of offset phenomenon.

EXAMPLES 2 and 3

Cyan Toners 2 and 3 were prepared in the same manner as in Example 1 except for using Charge Controller Compositions 2 and 3, respectively, and evaluated in the same manner as in Example 1. The results are shown in Tables 2-1 to 2-4.

Comparative Example 1

Cyan Toner 4 (comparative) was prepared in the same manner as in Example 1 except for using only Aluminum Compound 1 instead of Charge Controller Composition 1 and evaluated in the same manner as in Example 1. The results are shown in Tables 2-1 to 2-4.

Comparative Example 2

Cyan Toner 5 (comparative) was prepared in the same manner as in Example 1 except for using only Aluminum Compound 2 instead of Charge Controller Composition 1 and evaluated in the same manner as in Example 1. The results are shown in Tables 2-1 to 2-4.

Comparative Example 3

Cyan Toner 6 (comparative) was prepared in the same manner as in Example 1 except for using Charge Controller Composition 4 (comparative) instead of Charge Controller Composition 1 and evaluated in the same manner as in Example 1. The results are shown in Tables 2-1 to 2-4.

Cyan Toner 6 was liable to cause offset phenomenon, and the deterioration of the heating roller surface elastic layer was observed after the continuous image formation.

Comparative Example 4

Cyan Toner 7 (comparative) was prepared in the same manner as in Example 1 except for using Charge Controller Composition 5 (comparative) instead of Charge Controller Composition 1 and evaluated in the same manner as in Example 1. The results are shown in Tables 2-1 to 2-4.

Comparative Example 5

Cyan Toner 8 (comparative) was prepared in the same manner as in Example 1 except for using Charge Controller Composition 6 (comparative) instead of Charge Controller Composition 1 and evaluated in the same manner as in Example 1. The results are shown in Tables 2-1 to 2-4.

Comparative Example 6

Cyan Toner 9 (comparative) was prepared in the same manner as in Example 1 except for using Charge Controller Composition 7 (comparative) instead of Charge Controller Composition 1 and evaluated in the same manner as in Example 1. The results are shown in Tables 2-1 to 2-4.

EXAMPLES 4 to 11

Cyan Toners 10 to 17 were prepared in the same manner as in Example 1 except for using Charge Controller Compositions 8 to 15, respectively, and evaluated in the same manner as in Example 1. The results are shown in Tables 2-1 to 2-4.

EXAMPLE 12

Cyan Toner 18 was prepared in the same manner as in Example 1 except for using a polyester resin (acid value=40) obtained by polycondensation between propoxidized bisphenol and fumaric acid as the binder resin and evaluated in the same manner as in Example 1. The results are shown in Tables 2-1 to 2-4.

EXAMPLE 13

A polyester resin (acid value of substantially zero) was prepared by polycondensation accompanying trans-esterification between propoxidized bisphenol and methyl terephthalate. Cyan Toner 19 was prepared by using the polyester resin as the binder resin otherwise in the same manner as in Example 1 and evaluated in the same manner as in Example 1.

The results of Examples and Comparative Examples are inclusively shown in Tables 2-1 to 2-4 below. The evaluation methods and standards are given after the tables.

TABLE 2-1

| | Cyan toner | | Normal temperature/Normal humidity (23° C./60%) | | | | | | | | |
|---|---|---|---|---|---|---|---|---|---|---|---|
| | | | Initial stage | | | | After 10000 sheets | | | | |
| | Nos. | Agglomerat-ability (%) | TC (mC/kg) | I.D. | Fog | High-light | TC (mC/kg) | I.D. | Fog | High-light | Scatter |
| Ex. | | | | | | | | | | | |
| 1 | 1 | 7.7 | −25.0 | 1.72 | 0.8 | A | −25.5 | 1.73 | 1.0 | A | A |
| 2 | 2 | 8.1 | −25.5 | 1.71 | 0.7 | A | −25.8 | 1.70 | 0.8 | A | A |
| 3 | 3 | 8.3 | −23.8 | 1.74 | 0.8 | A | −23.4 | 1.76 | 0.8 | A | A |
| 4 | 10 | 10.1 | −25.4 | 1.68 | 0.8 | B | −24.9 | 1.67 | 0.9 | B | A |
| 5 | 11 | 11.3 | −24.9 | 1.65 | 0.9 | B | −20.4 | 1.82 | 1.5 | C | A |
| 6 | 12 | 11.4 | −24.5 | 1.66 | 1.0 | B | −20.3 | 1.81 | 1.5 | C | A |
| 7 | 13 | 10.7 | −23.0 | 1.70 | 1.0 | B | −22.8 | 1.68 | 0.9 | B | A |
| 8 | 14 | 10.9 | −30.2 | 1.52 | 1.2 | B | −31.2 | 1.52 | 1.0 | B | A |
| 9 | 15 | 12.1 | −27.8 | 1.68 | 1.1 | B | −28.6 | 1.61 | 1.1 | B | A |
| 10 | 16 | 10.3 | −30.3 | 1.58 | 1.0 | B | −28.2 | 1.62 | 1.2 | B | A |
| 11 | 17 | 10.2 | −25.9 | 1.71 | 1.0 | B | −22.0 | 1.73 | 1.5 | B | A |
| 12 | 18 | 11.0 | −24.9 | 1.67 | 2.0 | B | −21.0 | 1.68 | 1.2 | C | B |
| 13 | 19 | 11.0 | −29.0 | 1.66 | 1.0 | B | −33.2 | 1.52 | 1.3 | C | A |
| Comp. Ex. | | | | | | | | | | | |
| 1 | 4 | 11.5 | −26.8 | 1.70 | 0.9 | B | −22.0 | 1.75 | 1.5 | C | B |
| 2 | 5 | 11.7 | −25.5 | 1.69 | 0.9 | B | −21.3 | 1.76 | 1.7 | C | B |
| 3 | 6 | 11.9 | −26.4 | 1.65 | 0.9 | B | −40.9 | 1.30 | 1.1 | C | B |
| 4 | 7 | 12.2 | −26.4 | 1.68 | 1.0 | B | −18.2 | 1.79 | 1.5 | C | B |
| 5 | 8 | 22.4 | −25.4 | 1.69 | 1.2 | C | −16.5 | 1.80 | 2.0 | C | C |
| 6 | 9 | 23.8 | −24.9 | 1.70 | 1.4 | C | −15.5 | 1.82 | 2.3 | C | C |

TABLE 2-2

| | | High temperature/High humidity (30° C./80%) | | | | | | | | |
|---|---|---|---|---|---|---|---|---|---|---|
| | | Initial stage | | | | After 10000 sheets | | | | |
| | Cyan toner Nos. | TC (mC/kg) | I.D. | Fog | High-light | TC (mC/kg) | I.D. | Fog | High-light | Scatter |
| Ex. | | | | | | | | | | |
| 1 | 1 | −24.1 | 1.74 | 0.9 | A | −23.8 | 1.75 | 1.1 | A | A |
| 2 | 2 | −24.5 | 1.72 | 0.8 | A | −24.9 | 1.68 | 0.9 | A | A |
| 3 | 3 | −22.3 | 1.78 | 0.9 | A | −21.4 | 1.80 | 1.0 | A | A |
| 4 | 10 | −24.6 | 1.68 | 0.9 | B | −23.6 | 1.67 | 1.1 | B | A |
| 5 | 11 | −23.0 | 1.66 | 0.8 | B | −19.5 | 1.83 | 1.5 | C | B |
| 6 | 12 | −22.0 | 1.63 | 1.0 | B | −18.0 | 1.86 | 1.0 | C | B |
| 7 | 13 | −22.3 | 1.68 | 1.0 | B | −21.9 | 1.65 | 1.0 | B | A |
| 8 | 14 | −26.2 | 1.62 | 1.2 | B | −22.2 | 1.72 | 1.4 | B | A |
| 9 | 15 | −23.2 | 1.70 | 1.0 | B | −23.1 | 1.75 | 1.5 | B | A |
| 10 | 16 | −24.1 | 1.65 | 1.1 | B | −22.2 | 1.72 | 1.5 | B | A |
| 11 | 17 | −19.2 | 1.78 | 1.1 | B | −18.2 | 1.88 | 1.5 | C | B |
| 12 | 18 | −22.0 | 1.75 | 1.3 | C | −16.4 | 1.89 | 1.8 | C | B |
| 13 | 19 | −26.0 | 1.73 | 1.2 | C | −29.0 | 1.58 | 1.6 | C | B |
| Comp. Ex. | | | | | | | | | | |
| 1 | 4 | −22.1 | 1.78 | 1.5 | C | −15.0 | 1.86 | 2.9 | D | C |
| 2 | 5 | −20.5 | 1.79 | 1.4 | C | −14.3 | 1.80 | 3.2 | D | C |
| 3 | 6 | −24.0 | 1.72 | 0.9 | A | −29.5 | 1.50 | 1.2 | C | B |
| 4 | 7 | −23.9 | 1.73 | 1.0 | B | −14.1 | 1.85 | 2.2 | D | C |
| 5 | 8 | −22.8 | 1.76 | 1.4 | C | −13.2 | 1.82 | 2.8 | D | C |
| 6 | 9 | −22.4 | 1.80 | 1.5 | C | −12.9 | 1.88 | 3.0 | D | C |

TABLE 2-3

| | | Normal temperature/Low humidity (23° C./10%) | | | | | | | | |
|---|---|---|---|---|---|---|---|---|---|---|
| | | Initial stage | | | | After 10000 sheets | | | | |
| | Cyan toner Nos. | TC (mC/kg) | I.D. | Fog | High-light | TC (mC/kg) | I.D. | Fog | High-light | Scatter |
| Ex. | | | | | | | | | | |
| 1 | 1 | −26.1 | 1.70 | 0.7 | A | −26.0 | 1.71 | 0.8 | A | A |
| 2 | 2 | −26.5 | 1.68 | 0.8 | A | −26.4 | 1.68 | 0.9 | A | A |
| 3 | 3 | −25.5 | 1.70 | 0.6 | A | −25.4 | 1.72 | 0.7 | A | A |
| 4 | 10 | −26.2 | 1.65 | 0.8 | B | −28.0 | 1.52 | 0.9 | C | A |
| 5 | 11 | −25.2 | 1.70 | 0.9 | B | −26.0 | 1.68 | 1.0 | B | A |
| 6 | 12 | −24.9 | 1.72 | 1.0 | B | −26.0 | 1.65 | 1.1 | B | A |
| 7 | 13 | −25.4 | 1.67 | 1.1 | B | −31.0 | 1.50 | 1.2 | C | A |
| 8 | 14 | −31.2 | 1.51 | 1.1 | B | −32.0 | 1.50 | 1.1 | B | A |
| 9 | 15 | −28.8 | 1.68 | 0.8 | B | −29.8 | 1.60 | 1.1 | B | A |
| 10 | 16 | −31.2 | 1.56 | 0.9 | B | −31.0 | 1.60 | 1.0 | B | A |
| 11 | 17 | −24.0 | 1.70 | 1.0 | B | −24.2 | 1.70 | 1.0 | B | A |
| 12 | 18 | −25.0 | 1.68 | 0.8 | B | −23.8 | 1.71 | 0.9 | B | A |
| 13 | 19 | −29.2 | 1.68 | 0.9 | B | −33.4 | 1.46 | 1.0 | C | A |
| Comp. Ex. | | | | | | | | | | |
| 1 | 4 | −27.0 | 1.68 | 0.8 | B | −26.0 | 1.66 | 1.1 | B | B |
| 2 | 5 | −26.0 | 1.70 | 0.8 | B | −24.3 | 1.67 | 1.1 | B | B |
| 3 | 6 | −26.5 | 1.70 | 0.8 | B | −41.8 | 1.25 | 0.9 | C | B |
| 4 | 7 | −27.0 | 1.62 | 0.9 | A | −22.8 | 1.70 | 1.2 | B | B |
| 5 | 8 | −26.5 | 1.71 | 0.8 | B | −21.5 | 1.79 | 1.8 | C | B |
| 6 | 9 | −26.2 | 1.65 | 0.9 | B | −20.4 | 1.77 | 1.6 | C | B |

TABLE 2-4

| | | Low temperature/Low humidity (15° C./10%) | | | | | | | | |
|---|---|---|---|---|---|---|---|---|---|---|
| | | Initial stage | | | | After 10000 sheets | | | | |
| | Cyan toner Nos. | TC (mC/kg) | I.D. | Fog | High-light | TC (mC/kg) | I.D. | Fog | High-light | Scatter |
| Ex. | | | | | | | | | | |
| 1 | 1 | −28.0 | 1.68 | 0.5 | A | −27.5 | 1.69 | 0.6 | A | A |
| 2 | 2 | −28.6 | 1.67 | 0.6 | A | −28.3 | 1.68 | 0.7 | A | A |
| 3 | 3 | −27.8 | 1.67 | 0.5 | A | −27.9 | 1.68 | 0.6 | A | A |
| 4 | 10 | −26.5 | 1.67 | 0.8 | B | −29.0 | 1.50 | 0.8 | C | A |
| 5 | 11 | −26.4 | 1.65 | 0.9 | B | −27.2 | 1.60 | 1.0 | B | A |
| 6 | 12 | −27.2 | 1.66 | 1.0 | B | −28.2 | 1.60 | 1.1 | B | A |
| 7 | 13 | −26.4 | 1.68 | 0.9 | B | −32.0 | 1.48 | 1.2 | C | A |
| 8 | 14 | −32.0 | 1.50 | 0.8 | B | −33.0 | 1.48 | 1.0 | C | A |
| 9 | 15 | −29.0 | 1.68 | 0.9 | B | −30.0 | 1.61 | 1.1 | B | A |
| 10 | 16 | −32.0 | 1.55 | 0.6 | B | −31.2 | 1.58 | 0.8 | B | A |
| 11 | 17 | −25.0 | 1.70 | 0.7 | B | −24.8 | 1.70 | 0.9 | B | A |
| 12 | 18 | −25.0 | 1.70 | 0.7 | B | −24.0 | 1.70 | 0.9 | B | A |
| 13 | 19 | −30.0 | 1.65 | 0.8 | B | −34.0 | 1.45 | 0.9 | C | A |
| Comp. Ex. | | | | | | | | | | |
| 1 | 4 | −28.0 | 1.68 | 0.8 | B | −26.5 | 1.65 | 1.1 | B | A |
| 2 | 5 | −26.5 | 1.70 | 0.7 | B | −24.5 | 1.68 | 1.0 | B | A |
| 3 | 6 | −28.0 | 1.70 | 0.7 | B | −42.0 | 1.20 | 0.8 | C | A |
| 4 | 7 | −27.5 | 1.65 | 0.6 | A | −24.0 | 1.70 | 1.2 | B | B |
| 5 | 8 | −27.0 | 1.68 | 0.9 | B | −23.0 | 1.65 | 1.2 | B | B |
| 6 | 9 | −26.8 | 1.65 | 0.8 | B | −22.9 | 1.66 | 1.5 | B | B |

The evaluation results shown in the above Tables 2-1 to 2-4 and Tables 3-1 to 3-4 were obtained according to the methods and standards described below for the respective items.

I.D. (Image Density)

The image density of a solid image part (showing a gloss of 25–35 as measured by a gloss meter ("PG-3D", available from Nippon Hasshoku Kogyo K.K.)) was measured by using a Macbeth reflection densitometer available from Macbeth Co. Fog Fog (%) was evaluated as a difference in reflectance based on reflectance values measured by using "REFLECTOMETER MODEL TC-6DS" (available from Tokyo Denshoku K.K.) together with an accessory amber filter for cyan toner images and calculated according to the following equation. A smaller value represents less fog.

Fog (reflectance) (%)=[reflectance (%) of standard pager] −[reflectance (%) of non-image part of a sample]

Highlight (Image quality of highlight portion)

Image quality of a highlight portion of an image sample was compared with that of a standard image sample and evaluated at four levels.

A: excellent.

B: good.

C: fair.

D: poor.

Scatter (Toner scattering)

The degree of toner scattering out of the developing device within the copying apparatus was evaluated by eye observation at three level.

A: Substantially no toner scattering.

B: A little scattered toner but little influence.

C: Remarkable scattered toner.

EXAMPLES 14 to 16

Magenta Toner, Yellow Toner and Black Toner were respectively prepared in the same manner as in Example 1 except for using 5 wt. parts of a magenta colorant (C.I. Pigment Red 122), 6 wt. parts of a yellow colorant (C.I. Pigment Yellow) and 5 wt. parts of a black colorant (carbon black), respectively, in place of the phthalocyanine pigment.

The respective toners were respectively evaluated according to a single-color mode image-formation in the same manner as in Example 1, whereby similarly good results as in Example 1 were respectively obtained.

Further, a full-color mode image forming test was performed by using the above-prepared three color toners of (magenta, yellow and black) in addition to Cyan Toner 1 prepared in Example 1, full-color images faithfully reproducing the colors of an original image were obtained in the respective environments.

EXAMPLE 17

| | |
|---|---|
| Styrene-butyl acrylate-monoethyl maleate copolymer (Mw = $2 \times 10^5$ (main peak at 4000, sub-peak at $4 \times 10^5$), AV = 7) | 100 wt. parts |
| Magnetic iron oxide (Dav = 0.18 μm; Hc = 121 oersted at 10 kilo-oersted $\sigma_s$ = 83 emu/g, $\sigma_r$ = 11 emu/g) | 80 wt. parts |
| Low-molecular weight propylene-ethylene copolymer | 3 wt. parts |
| Charge Controller Composition 1 | 2 wt. parts |

The above ingredients were pre-blended in a Henschel mixer and melt-kneaded through a twin screw extruder. After being cooled, the kneaded product was coarsely crushed by a cutter mill and finely pulverized by an air jet pulverizer followed by classification by a pneumatic classifier to obtain negatively chargeable magnetic toner particles having a weight average particle size ($D_4$) of 7 μm.

100 wt. parts of the magnetic toner particles and 0.4 wt. part of hydrophobic dry process silica ($S_{BET}$=200 $m^2/g$)

were sufficiently blended in a Henschel mixer to obtain a magnetic toner. The magnetic toner was subjected to a continuous copying test on 10,000 sheets for each of the four environments as in Example 1 by using a commercially available high-speed copying machine equipped with an a-Si photosensitive drum for normal development of positive polarity electrostatic image ("NP-8580", available from Canon K.K.) at a copying speed of 82 A4-sheets per min.

In the respective environments, images having an image density of at least 1.4 were obtained while suppressing the occurrence of fog.

EXAMPLE 18

Into 650 wt. parts of deionized water, 510 wt. parts of 0.1M-$Na_3PO_4$ aqueous solution was added, and the system was warmed at 60° C. and stirred at 12000 rpm by a TK-type homomixer (available from Tokushu Kika Kogyo K.K.). To the system, 75 wt. parts of 1.0M-$CaCl_2$ aqueous solution was gradually added to form an aqueous medium containing $Ca_3(PO_4)_2$.

| | |
|---|---|
| Styrene | 160 wt. parts |
| n-Butyl acrylate | 40 wt. parts |
| Copper-phthalocyanine pigment (C.I. Pigment Blue 15:3) | 7.5 wt. parts |
| Styrene/methacrylic acid/ methyl methacrylate copolymer (monomer wt. ratios = 85/5/10, Mw = ca. $5.7 \times 10^4$, AV = 19.5) | 9 wt. parts |
| Charge Controller Composition 1 | 5 wt. parts |
| Ester wax | 30 wt. parts |

The above ingredients were warmed at 60° C. and subjected to uniform dissolution and dispersion by using a TK-type homomixer at 12,000 rpm. To the mixture, 9 wt. parts of 2,2'-azobis(2,4-dimethylvaleronitrile) (polymerization initiator) to prepare a polymerizable monomer composition, wherein Charge Controller Composition 1 was uniformly dissolved in the monomer.

The polymerizable monomer composition was charged in the above-prepared aqueous medium, and the system was stirred by a TK-type homomixer at 10,000 rpm for 22 min. at 60° C. in an $N_2$ environment to form particles of the polymerizable monomer composition dispersed in the aqueous medium. Then, the system was continually stirred by a paddle stirring blade and heated to 80° C. for 10 hours of reaction. After completion of the polymerization reaction, the system was cooled and hydrochloric acid was added thereto to dissolve the calcium phosphate. Then, the polymerizate was recovered by filtration, washed with water and dried to obtain cyan toner particles.

To 100 wt. parts of the cyan toner particles, 2.0 wt. parts of hydrophobic titanium oxide fine powder (Dav.=0.06 μm) was added to obtain Polymerized Cyan Toner 1, which showed a weight-average particle size ($D_4$)=6.2 μm.

By using 5 wt. parts of Polymerized Cyan Toner 1 (together with 95 wt. parts of the carrier), a two-component type developer was prepared otherwise in the same manner as in Example 1 and evaluated in the manner as in Example 1. The results are shown in Tables 3-1 to 3-4.

EXAMPLES 19 and 20

Polymerized Cyan Toners 2 an 3 were prepared in the same manner as in Example 18 except for using Charge Controller Compositions 2 an 3, respectively, and evaluated in the same manner as in Example 18. The results are shown in Tables 3-1 to 3-4.

Comparative Examples 7–10

Polymerized Cyan Toners 4–7 (comparative) were prepared in the same manner as in Example 18 except for using Charge Controller Compositions 4–7, respectively, and evaluated in the same manner as in Example 18.

The results of Examples 18–20 and Comparative Examples 7–10 are summarized in Tables 3-1 to 3-4 according to similar standards as in Tables 2-1 to 2-4 above.

TABLE 3-1

| | | Particle size distribution** | | | Normal temperature/Normal humidity (23° C./60%) | | | | | | | | |
|---|---|---|---|---|---|---|---|---|---|---|---|---|---|
| | | | | | Initial stage | | | | After 10000 sheets | | | | |
| | Polymerized cyan toner | D4 (μm) | ≦3.17 μm (N %) | ≧10.08 μm (V %) | TC (mC/kg) | I.D. | Fog | High-light | TC (mC/kg) | I.D. | Fog | High-light | Scatter |
| Ex. | | | | | | | | | | | | | |
| 18 | 1 | 6.2 | 13.8 | 3.6 | −24.5 | 1.73 | 0.8 | A | −25.0 | 1.73 | 1.0 | A | A |
| 19 | 2 | 6.3 | 13.7 | 3.7 | −25.0 | 1.72 | 0.7 | A | −25.2 | 1.70 | 0.8 | A | A |
| 20 | 3 | 6.3 | 13.9 | 3.6 | −23.2 | 1.75 | 0.8 | A | −23.0 | 1.76 | 0.8 | A | A |
| Comp. Ex. | | | | | | | | | | | | | |
| 7 | 4 | 5.7 | 33.3 | 5.5 | −25.9 | 1.66 | 0.9 | B | −40.1 | 1.30 | 1.1 | C | B |
| 8 | 5 | 8.7 | 19.2 | 12.3 | −25.8 | 1.69 | 1.0 | B | −17.7 | 1.78 | 1.5 | C | B |
| 9 | 6 | 8.3 | 21.4 | 9.4 | −24.8 | 1.70 | 1.2 | B | −16.0 | 1.81 | 2.0 | C | C |
| 10 | 7 | 8.2 | 22.5 | 8.9 | −24.3 | 1.70 | 1.4 | C | −15.0 | 1.82 | 2.3 | C | C |

**D4: Weight-average particle size (μm).
≦3.17 μm (N %): The content in % by number of particles having particle sizes of at most 3.17 μm.
≧10.08 μm (V %): The content in % by volume of particles having particle sizes of at least 10.08 μm.

TABLE 3-2

| | Polymerized | High temperature/Normal humidity | | | | | | | | |
|---|---|---|---|---|---|---|---|---|---|---|
| | | Initial stage | | | | After 10000 sheets | | | | |
| | Cyan toner Nos. | TC (mC/kg) | I.D. | Fog | High-light | TC (mC/kg) | I.D. | Fog | High-light | Scatter |
| Ex. | | | | | | | | | | |
| 18 | 1 | −23.6 | 1.74 | 0.9 | A | −23.5 | 1.74 | 1.1 | A | A |
| 19 | 2 | −24.0 | 1.73 | 0.8 | A | −24.4 | 1.67 | 0.9 | A | A |
| 20 | 3 | −21.8 | 1.77 | 0.9 | A | −21.0 | 1.79 | 1.0 | A | A |
| Comp. Ex. | | | | | | | | | | |
| 7 | 4 | −23.5 | 1.72 | 0.9 | A | −29.0 | 1.51 | 1.2 | C | B |
| 8 | 5 | −23.4 | 1.73 | 1.0 | B | −13.6 | 1.84 | 2.2 | D | C |
| 9 | 6 | −22.3 | 1.76 | 1.4 | C | −12.7 | 1.81 | 2.7 | D | C |
| 10 | 7 | −22.0 | 1.79 | 1.4 | C | −12.4 | 1.87 | 3.1 | D | C |

TABLE 3-3

| | Polymerized | Normal temperature/Low humidity | | | | | | | | |
|---|---|---|---|---|---|---|---|---|---|---|
| | | Initial stage | | | | After 10000 sheets | | | | |
| | Cyan toner Nos. | TC (mC/kg) | I.D. | Fog | High-light | TC (mC/kg) | I.D. | Fog | High-light | Scatter |
| Ex. | | | | | | | | | | |
| 18 | 1 | −25.6 | 1.70 | 0.7 | A | −25.5 | 1.71 | 0.8 | A | A |
| 19 | 2 | −26.0 | 1.67 | 0.8 | A | −26.0 | 1.67 | 0.9 | A | A |
| 20 | 3 | −25.0 | 1.69 | 0.6 | A | −25.0 | 1.71 | 0.7 | A | A |
| Comp. Ex. | | | | | | | | | | |
| 7 | 4 | −26.0 | 1.69 | 0.8 | B | −41.2 | 1.24 | 0.9 | C | A |
| 8 | 5 | −26.5 | 1.62 | 0.9 | A | −22.2 | 1.70 | 1.2 | B | B |
| 9 | 6 | −26.0 | 1.70 | 0.8 | B | −21.0 | 1.78 | 1.8 | C | B |
| 10 | 7 | −25.7 | 1.64 | 0.9 | B | −19.9 | 1.78 | 1.6 | C | B |

TABLE 3-4

| | Polymerized | Low temperature/Low humidity | | | | | | | | |
|---|---|---|---|---|---|---|---|---|---|---|
| | | Initial stage | | | | After 10000 sheets | | | | |
| | Cyan toner Nos. | TC (mC/kg) | I.D. | Fog | High-light | TC (mC/kg) | I.D. | Fog | High-light | Scatter |
| Ex. | | | | | | | | | | |
| 18 | 1 | −27.5 | 1.68 | 0.5 | A | −27.0 | 1.69 | 0.6 | A | A |
| 19 | 2 | −28.1 | 1.67 | 0.6 | A | −27.7 | 1.68 | 0.7 | A | A |
| 20 | 3 | −27.3 | 1.67 | 0.5 | A | −27.1 | 1.67 | 0.6 | A | A |
| Comp. Ex. | | | | | | | | | | |
| 7 | 4 | −27.5 | 1.70 | 0.7 | B | −41.5 | 1.21 | 0.8 | C | A |
| 8 | 5 | −27.0 | 1.64 | 0.6 | A | −23.5 | 1.70 | 1.2 | B | B |
| 9 | 6 | −26.3 | 1.68 | 0.9 | B | −22.5 | 1.65 | 1.2 | B | B |
| 10 | 7 | −26.3 | 1.65 | 0.8 | B | −22.4 | 1.66 | 1.5 | B | B |

What is claimed is:

1. A toner for developing electrostatic images, comprising: toner particles comprising (a) a binder resin, (b) a colorant or magnetic material, (c) an aromatic hydroxycarboxylic acid (A), and (d) a metal compound of the aromatic hydroxycarboxylic acid (A); wherein (c) the aromatic hydroxycarboxylic acid (A) and (d) the metal compound of the aromatic hydroxycarboxylic acid (A) are contained in a weight ratio of 1:99 to 10:90.

2. The toner according to claim 1, wherein said aromatic hydroxycarboxylic acid (A) is dialkylsalicylic acid and said metal compound of the aromatic hydroxycarboxylic acid (A) is an aluminum compound of dialkylsalicylic acid.

3. The toner according to claim 1, wherein said aromatic hydroxycarboxylic acid (A) is monoalkylsalicylic acid and said metal compound of the aromatic hydroxycarboxylic acid (A) is an aluminum compound of monoalkylsalicylic acid.

4. The toner according to claim 1, wherein said aromatic hydroxycarboxylic acid (A) is dialkylsalicylic acid and said metal compound of the aromatic hydroxycarboxylic acid (A) is a zinc compound of dialkylsalicylic acid.

5. The toner according to claim 1, wherein said aromatic hydroxycarboxylic acid (A) is monoalkylsalicylic acid and said metal compound of the aromatic hydroxycarboxylic acid (A) is a zinc compound of monoalkylsalicylic acid.

6. The toner according to claim 1, wherein said aromatic hydroxycarboxylic acid (A) is dialkylsalicylic acid and said metal compound of the aromatic hydroxycarboxylic acid (A) is a chromium compound of dialkylsalicylic acid.

7. The toner according to claim 1, wherein said aromatic hydroxycarboxylic acid (A) is monoalkylsalicylic acid and said metal compound of the aromatic hydroxycarboxylic acid (A) is a chromium compound of monoalkylsalicylic acid.

8. The toner according to claim 1, wherein said binder resin comprises a polyester resin.

9. The toner according to claim 8, wherein said polyester resin has an acid value of 1 to 35 KOH/g.

10. The toner according to claim 1, wherein said binder resin comprises a mixture of a styrene copolymer and a polyester resin.

11. The toner according to claim 10, wherein said polyester resin has an acid value of 1 to 35 KOH/g.

12. The toner according to claim 1, wherein said metal compound of the aromatic hydroxycarboxylic acid (A) comprises a mixture of metal compounds having mutually different numbers of aromatic hydroxycarboxylic acid molecules bonded per metal atom.

13. The toner according to claim 12, wherein said metal compound of the aromatic hydroxycarboxylic acid (A) comprises a mixture of aluminum compounds having mutually different numbers of aromatic hydroxycarboxylic acid molecules bonded per aluminum atom.

14. The toner according to claim 13, wherein said metal compound of the aromatic hydroxycarboxylic acid (A) comprises a mixture of an aluminum compound having one aromatic hydroxycarboxylic acid molecule bonded per aluminum atom and an aluminum compound having 1.5 aromatic hydroxycarboxylic acid molecules bonded per aluminum atom.

15. The toner according to claim 1, wherein said toner particles have been prepared by dispersing a polymerizable monomer composition comprising at least a polymerizable monomer, a colorant or magnetic material, an aromatic hydroxycarboxylic acid (A), a metal compound of the aromatic hydroxycarboxylic acid (A) and a polymerization initiator in an aqueous medium to form particles of the polymerizable monomer composition therein; and polymerizing the polymerizable monomer in the particles of the polymerizable monomer composition in the aqueous medium; the polymerizable monomer composition containing said aromatic hydroxycarboxylic acid (A) and said metal compound of the aromatic hydroxycarboxylic acid (A) in a weight ratio of 1:99 to 10:90.

16. The toner according to claim 1, wherein said toner particles have been prepared by melt-kneading a mixture comprising at least a binder resin, a colorant or magnetic material, an aromatic hydroxycarboxylic acid (A) and a metal compound of the aromatic hydroxycarboxylic acid (A), cooling the melt-kneaded product, pulverizing the cooled kneaded product, and classifying the pulverizate; the mixture containing said aromatic hydroxycarboxylic acid (A) and said metal compound of the aromatic hydroxycarboxylic acid (A) in a weight ratio of 1:99 to 10:90.

17. The toner according to claim 1, wherein said toner particles contain 0.1–20 wt. parts of a non-magnetic colorant, 0.05–1.5 wt. parts of the aromatic hydroxycarboxylic acid (A) and 0.45–13.5 wt. parts of the metal compound of the aromatic hydroxycarboxylic acid (A) respectively per 100 wt. parts of the binder resin.

18. The toner according to claim 1, wherein said toner particles contain 20–200 wt. parts of the magnetic material, 0.05–1.5 wt. parts of the aromatic hydroxycarboxylic acid (A) and 0.45–13.5 wt. parts of the metal compound of the aromatic hydroxycarboxylic acid (A) respectively per 100 wt. parts of the binder resin.

19. The toner according to claim 1, wherein said aromatic hydroxycarboxylic acid (A) is di-tert-butylsalicylic acid.

20. The toner according to claim 1, wherein said toner particles are negatively triboelectrically chargeable toner particles.

21. The toner according to claim 1, further including hydrophobic titanium oxide particles carried on the surfaces of the toner particles.

* * * * *

UNITED STATES PATENT AND TRADEMARK OFFICE

CERTIFICATE OF CORRECTION

PATENT NO. : 5,747,209

DATED : May 5, 1998

INVENTOR(S): TSUHOSHI TAKIGUCHI ET AL.

It is certified that error appears in the above-identified patent and that said Letters Patent is hereby corrected as shown below:

TITLE PAGE AT [56] REFERENCES CITED, ATTORNEY, AGENT OR FIRM

"Fitzpatrick, Cella, Harber & Scinto" should read --Fitzpatrick, Cella, Harper & Scinto--.

COLUMN 1

Line 40, "depending" should read --depending upon--.

COLUMN 2

Line 8, delete "a".

COLUMN 7

Line 43, "chmarone-indene" should read --cumarone-indene--;
Line 49, "derivative" should read --derivatives--.

COLUMN 8

Line 49 "$H-(OR-O)_x-$" should read -- $H-(OR-)_xO-$ --.

UNITED STATES PATENT AND TRADEMARK OFFICE

CERTIFICATE OF CORRECTION

PATENT NO. : 5,747,209

DATED : May 5, 1998

INVENTOR(S): TSUHOSHI TAKIGUCHI ET AL.

It is certified that error appears in the above-identified patent and that said Letters Patent is hereby corrected as shown below:

COLUMN 9

Line 5, "$2X10^5<|P_1-P_2<4X10^6$." should read --$2X10^5<|P_1-P_2|<4X10^6$.--;
Line 16, "Watching" should read --Watchung--;
Line 53, "include;" should read --include:--.

COLUMN 10

Line 56, "the" should read --then--.

COLUMN 13

Line 11, "control of" should read --control--;
Line 26, "been" should read --even--;
Line 48, "prepared" should read --preferred--.

COLUMN 14

Line 13, "coupling" should read --coupling agent--;
Line 15, "$C_aH_{2a+1}$—" should read -- $C_\alpha H_{2\alpha+1}$— --;
Line 18, "a" should read --$\alpha$--;
Line 20, "a" should read --$\alpha$--;
Line 30, "30-90%" should read --30-90%,--.

UNITED STATES PATENT AND TRADEMARK OFFICE

CERTIFICATE OF CORRECTION

PATENT NO. : 5,747,209

DATED : May 5, 1998

INVENTOR(S): TSUHOSHI TAKIGUCHI ET AL.

It is certified that error appears in the above-identified patent and that said Letters Patent is hereby corrected as shown below:

COLUMN 16

Line 59, "Counter" should read --Coulter--.

COLUMN 17

Line 60, "(a/5+" should read -- (a/5)+ --

COLUMN 19

Line 10, "atoms." should read --atom.--;
Line 60, "1was" should read --1 was--.

COLUMN 22

Line 51, "temperature/normal" should read --temperature/low--.

COLUMN 27

Line 39, "Fog" should read --¶ Fog--;
Line 59, "level." should read --levels.--.

UNITED STATES PATENT AND TRADEMARK OFFICE

CERTIFICATE OF CORRECTION

PATENT NO. : 5,747,209

DATED : May 5, 1998

INVENTOR(S): TSUHOSHI TAKIGUCHI ET AL.

It is certified that error appears in the above-identified patent and that said Letters Patent is hereby corrected as shown below:

COLUMN 29

Line 36, "initiator)" should read --initiator) was added--.

COLUMN 30

Line 25, "an" should read --and--;
Line 27, "an" should read --and--.

Signed and Sealed this

Twenty-sixth Day of January, 1999

*Attest:*

*Attesting Officer*

*Acting Commissioner of Patents and Trademarks*

UNITED STATES PATENT AND TRADEMARK OFFICE

CERTIFICATE OF CORRECTION

PATENT NO. : 5,747,209

DATED : May 5, 1998

INVENTOR(S): TSUYOSHI TAKIGUCHI ET AL.

It is certified that error appears in the above-identified patent and that said Letters Patent is hereby corrected as shown below:

COLUMN 33

Line 33, "KOH/g" should read --mgKOH/g--;

Line 38, "KOH/g" should read --mgKOH/g--.

Signed and Sealed this

Twenty-fifth Day of May, 1999

*Attest:*

Q. TODD DICKINSON

*Attesting Officer*

*Acting Commissioner of Patents and Trademarks*